US005957479A

United States Patent [19]

Bayer et al.

[11] Patent Number: 5,957,479

[45] Date of Patent: Sep. 28, 1999

[54] SNOWBOARD BINDING ASSEMBLY

[75] Inventors: Seth W. Bayer, Boulder, Colo.; Gerald R. Anderson, Campbell; Wiley A. Kittrell, Fremont, both of Calif.; Todd R. Finney, State College, Pa.

[73] Assignee: Items International, Inc.

[21] Appl. No.: 08/808,851

[22] Filed: Feb. 28, 1997

Related U.S. Application Data

[63] Continuation-in-part of application No. 08/700,743, Jul. 9, 1996, abandoned, which is a continuation-in-part of application No. PCT/US96/02806, Feb. 29, 1996, which is a continuation-in-part of application No. 08/597,890, Feb. 5, 1996, abandoned, which is a continuation-in-part of application No. 08/451,694, May 26, 1995, abandoned, which is a continuation-in-part of application No. 08/397,448, Mar. 2, 1995, abandoned.

[51] Int. Cl.[6] ..... A63C 9/20

[52] U.S. Cl. ..... 280/624; 280/633; 280/14.2

[58] Field of Search ..... 280/624, 626, 280/14.2, 617, 618, 620, 623, 627, 633, 634, 635, 636

[56] References Cited

U.S. PATENT DOCUMENTS

| | | |
|---|---|---|
| Re. 33,350 | 9/1990 | Stuart . |
| 3,560,011 | 2/1971 | Spademan . |
| 3,606,370 | 9/1971 | Spademan . |
| 3,732,635 | 5/1973 | Marker . |
| 3,875,687 | 4/1975 | Henderson . |
| 3,900,204 | 8/1975 | Weber . |
| 4,281,468 | 8/1981 | Giese et al. . |
| 4,461,098 | 7/1984 | Diegelman . |
| 4,720,927 | 1/1988 | Abegg . |
| 4,773,886 | 9/1988 | Teeter et al. . |
| 4,793,077 | 12/1988 | Walkhoff et al. . |
| 4,825,566 | 5/1989 | Sartor . |
| 4,973,073 | 11/1990 | Raines et al. . |
| 5,029,890 | 7/1991 | Pfaffenbichler et al. . |
| 5,031,340 | 7/1991 | Hilgarth . |
| 5,031,341 | 7/1991 | Paris et al. . |
| 5,035,443 | 7/1991 | Kincheloe . |
| 5,054,807 | 10/1991 | Fauvet . |
| 5,069,463 | 12/1991 | Baud et al. . |
| 5,145,202 | 9/1992 | Miller . |
| 5,156,644 | 10/1992 | Koehler et al. . |
| 5,190,311 | 3/1993 | Carpenter et al. . |
| 5,193,294 | 3/1993 | Pozzoban et al. . |
| 5,216,826 | 6/1993 | Chaigne et al. . |
| 5,299,823 | 4/1994 | Glaser . |
| 5,435,080 | 7/1995 | Meiselman . |
| 5,493,793 | 2/1996 | Pozzoban et al. . |
| 5,499,461 | 3/1996 | Danezin et al. . |
| 5,505,478 | 4/1996 | Napoliello ..... 280/618 |
| 5,520,406 | 5/1996 | Anderson et al. ..... 280/624 |
| 5,577,757 | 11/1996 | Riepl et al. . |
| 5,690,351 | 11/1997 | Karol . |

FOREIGN PATENT DOCUMENTS

| | | |
|---|---|---|
| 72766 | 5/1985 | European Pat. Off. . |
| 455104 | 5/1990 | European Pat. Off. . |
| 704174 | 4/1996 | European Pat. Off. . |
| 2600548 | 12/1987 | France . |
| 2628981 | 9/1989 | France . |
| 2689776 | 10/1993 | France . |
| 2699828 | 7/1994 | France ..... 280/14.2 |
| 28 51 390 | 6/1980 | Germany . |
| 4202788 | 2/1991 | Germany . |
| 94 13356.5 | 1/1995 | Germany . |
| 1281276 | 1/1987 | Russian Federation . |

OTHER PUBLICATIONS

Partial International Search Report issued in PCT/US96/02806.

*Primary Examiner*—Robert J. Oberleitner
*Assistant Examiner*—Bridget Avery
*Attorney, Agent, or Firm*—Reed Smith Shaw & McClay LLP

[57] ABSTRACT

A binding assembly includes a boot having a plate, and a binding plate secured to a snowboard. The boot plate includes at least one set of opposing, horizontally-projecting, binding tabs positioned along the sides of the boot. The binding plate includes at least one set of binding elements that correspond, respectively, to the binding tabs. In operation, the binding tabs on the boot are maneuvered to engage the binding elements on the binding plate to mount the boot to the snowboard.

17 Claims, 39 Drawing Sheets

SNOWBOARD BINDING ASSEMBLY

CROSS-REFERENCE TO RELATED APPLICATION

This application is a continuation-in-part of application Ser. No. 08/700,743, filed on Jul. 9, 1996, now abandoned, which is a continuation-in-part of PCT International Application Ser. No. PCT/US96/02806, filed on Feb. 29, 1996, which designated the United States of America, which is a continuation-in-part of application Ser. No. 08/597,890, filed on Feb. 5, 1996, now abandoned, which is a continuation-in-part of application Ser. No. 08/451,694, filed on May 26, 1995, now abandoned, which is a continuation-in-part of abandoned application Ser. No. 08/397,448, filed on Mar. 2, 1995, now abandoned, the contents of which are hereby incorporated by reference.

BACKGROUND OF THE INVENTION

The present invention relates generally to the field of binding assemblies and, more particularly, to an improved binding assembly for snowboards.

Over the last decade, snowboarding has become a very popular winter sport in the United States and other countries. While skiing and snowboarding are usually performed on the same slopes, they differ significantly from each other. For example, rather than having separate skis for each foot and poles for each hand, a snowboarder has both feet secured to a single, relatively wide board, and no poles are used. In addition, unlike skiing, snowboard bindings are mounted on the snowboard at an angle to the longitudinal axis thereof.

Furthermore, to protect a skier's ankles and knees during a fall, skis are provided with safety release bindings to disengage the ski boots therefrom. Because a snowboarder has both feet attached to a single board, the twisting force from a fall is transmitted to the person's torso, rather than to the ankles or knees. Nevertheless, in an attempt to protect snowboarders from the injuries incurred by skiers, ski safety-release bindings have been adapted for use on snowboards. However, because snowboards encounter different forces than skis, and further because a snowboarder's feet are positioned differently on the snowboard than are a skier's feet on skis, conventional ski safety-release bindings have not proven satisfactory for use on snowboards. Moreover, a significant danger in using safety-release bindings on snowboards is presented when only one boot is released during a fall. Since snowboards are substantially heavier than individual skis, the torsional strain imparted to the knees or ankles of a snowboarder by the release of only one boot is greater than that imparted to a fallen skier. In fact, to prevent one of the boots from disengaging from the snowboard and thereby possibly causing injury to the knee or ankle of the other leg that remains secured to the snowboard, the use of safety-release bindings on snowboards has been discouraged.

Because snowboarders do not use poles, they virtually cannot maneuver their snowboards over relatively level ground (e.g., when attempting to maneuver into a chair lift). To propel themselves along the ground in "skateboard" fashion, snowboarders must be able to remove at least one boot from the snowboard. With conventional snowboard bindings, a snowboarder has to unbuckle or unstrap the boot from the snowboard. This is a cumbersome and time-consuming task. Furthermore, to prevent unnecessary injury after alighting onto the ski lift with at least one boot freed from the bindings, the snowboarder may want to reattach the boot to the snowboard before the ski lift reaches the top of the slope. While unbuckling or unstrapping one of the boots from the snowboard is difficult enough on level ground, reattaching the boot while hanging in midair on a chairlift is even more difficult. Therefore, an easily manipulated binding assembly for a snowboard has been desired.

An additional feature of conventional snowboard bindings is a boot backbrace or "highback" connected thereto. To initiate a heel turn, a snowboarder must lift the edge of her snowboard that is adjacent to her toes. Because people typically do not have sufficient muscle in their lower legs to elevate that edge of their snowboards, backbraces have been added to binding mechanisms. These backbraces are used by snowboarders to transmit their body weight to the snowboard to lift the required edge thereof. To reduce the discomfort and weight of binding assemblies, a backbrace that is disposed within a snowboard boot and is rigid in one direction yet flexible in other directions has also been desired.

SUMMARY OF THE INVENTION

The present invention provides a "step-in" binding mechanism for a snowboard that allows a snowboarder to quickly and conveniently detach one or both boots from the snowboard when required. Further, the binding mechanism allows the snowboarder to easily reattach the boot to the snowboard while riding on a chairlift or just before beginning a downhill run. In addition, to prevent injury the binding assembly is designed to retain the snowboarder's boots therein during a fall. Moreover, the present invention provides a snowboard boot having an internally-disposed, semi-rigid highback that stiffens the rear end of the boot for turning, yet allows the rest of the boot to remain flexible.

According to a first aspect of the present invention, one or both of the boots worn by the snowboarder includes a plate having at least one set of opposing, horizontally-projecting tabs positioned along the sides thereof. The tabs of the mounted boot(s) are gripped by at least one set of mating binding elements disposed on a binding plate mounted on a snowboard. The binding elements preferably include a recess adapted to receive the corresponding tabs of the boot, thereby enabling the snowboarder to "step into" the binding assembly. Preferably, the binding elements are formed from a ratchet-and-pawl combination to lock the tabs into place in the binding assembly. After the ratchet-and-pawl combination locks the tabs into place, the pawl prevents the binding elements from loosening and thereby releasing the boot from the snowboard (i.e., during a fall). To release the boot from the binding assembly, a ratchet lever attached to the binding elements is manually activated. This operation disengages the pawls from the ratchets and allows an upward force from the boot to rotate the binding elements to a boot-release position.

According to a second aspect of the present invention, a boot includes an outsole adhesively secured to a midsole and an internal midsole secured to the midsole. The lasting margin of the upper portion of the boot is captured between the midsole and the internal midsole. The top surface of the midsole and the bottom surface of the internal midsole each define a ridge. The ridges are off-set from one another and cooperate to pinch the lasting margin therebetween. Moreover, one or several bolts, such as T-bolts, may be disposed through the midsole and the internal midsole to further secure the lasting margin. Preferably, the boot tabs for the binding mechanism are integrally formed with the midsole.

According to a third aspect of the present invention, a boot includes an internal, semi-rigid highback that substantially stiffens the rear of the boot, yet allows the rest of the boot to remain flexible for snowboarder mobility. The backbrace allows a snowboarder to distribute her body weight to the back of the boot to initiate turns or other maneuvers on the snowboard.

According to a fourth aspect of the present invention, a method for forming a snowboard boot includes the following steps: forming a midsole insert from a first material, the midsole insert having binding tabs integrally formed therewith; forming a shell around the midsole insert such that the midsole insert substantially defines the bottom surface of the shell, the shell being formed from a second, more flexible material than the midsole insert; and securing the upper portion of the boot to the shell. Preferably, the midsole insert and the shell are formed by an injection molding process.

According to a fifth aspect of the present invention, one or both of the boots worn by the snowboarder includes a set of two, horizontally-projecting, binding tabs positioned along opposing sides thereof. A first binding element is rotatably associated with a snowboard and is configured to receive a first binding tab of the boot. A second binding element is rotatably and translationally associated with the snowboard and is configured to receive a second binding tab of the boot. The binding tabs on the boot are maneuvered to engage the binding elements on the snowboard to mount the boot to the snowboard. Each of the binding elements preferably defines a recess adapted to receive the corresponding tabs of the boot, thereby enabling the snowboarder to "step into" the binding assembly.

According to a sixth aspect of the present invention, a binding assembly includes a boot having two substantially parallel sides disposed between a front end and a rear end, and a set of two, horizontally-projecting, binding tabs positioned along opposing sides of the boot. A first binding element is rotatably associated with a snowboard and is configured to receive a first binding tab of the boot. A second binding element is rotatably associated with the snowboard and is configured to receive a second binding tab of the boot. The second binding element includes a releasable locking mechanism for locking the second binding element in a closed position. The binding tabs on the boot are maneuvered to engage the binding elements on the snowboard to mount the boot to the snowboard.

According to a seventh aspect of the present invention, a binding assembly includes a boot having a set of two binding tabs positioned along opposing sides of the boot. A first binding element is rotatably associated with a snowboard and is configured to receive a first binding tab. A second binding element is rotatably associated with the snowboard and is configured to receive a second binding tab. The second binding element includes a releasable locking mechanism having an inclined spiral plane for locking the second binding element in a closed position. The binding tabs on the boot are maneuvered to engage the binding elements on the snowboard to mount the boot to the snowboard.

The present invention provides a snowboard binding assembly, including snowboard boots and bindings, that allows a snowboarder to quickly and easily detach and reattach snowboard boots to a snowboard. The binding assembly is preferably manually operated and is intended to retain the boots on the snowboard during a fall.

The present invention, together with other aspects and attendant advantages, will best be understood upon consideration of the following detailed description taken in conjunction with the accompanying drawings.

BRIEF DESCRIPTION OF THE DRAWINGS

FIG. 32 is a rear perspective view of the outer binding element in a fully open position.

FIG. 33 is a side view taken along line 33—33 of FIG. 32.

FIG. 34 is a rear perspective view of the outer binding element just subsequent to a boot tab having been inserted therein.

FIG. 35 is a side view taken along line 35—35 of FIG. 34.

FIG. 36 is a rear perspective view of the outer binding element after the outer binding element has been rotated a few degrees.

FIG. 37 is a side view taken along line 37—37 of FIG. 36.

FIG. 38 is a rear perspective view of the outer binding element in a fully closed and locked position.

FIG. 39 is a side view taken along line 39—39 of FIG. 38.

FIG. 40 is a rear perspective view of the outer binding element in a fully closed yet unlocked position.

FIG. 41 is a side view taken along line 41—41 of FIG. 40.

DETAILED DESCRIPTION OF THE PRESENTLY PREFERRED EMBODIMENTS

Typically, every snowboard or similar device includes two binding assemblies—one for each boot worn by the snowboarder. However, for ease of explanation, the present invention is described at times below in terms of a single binding assembly.

Figure 1:
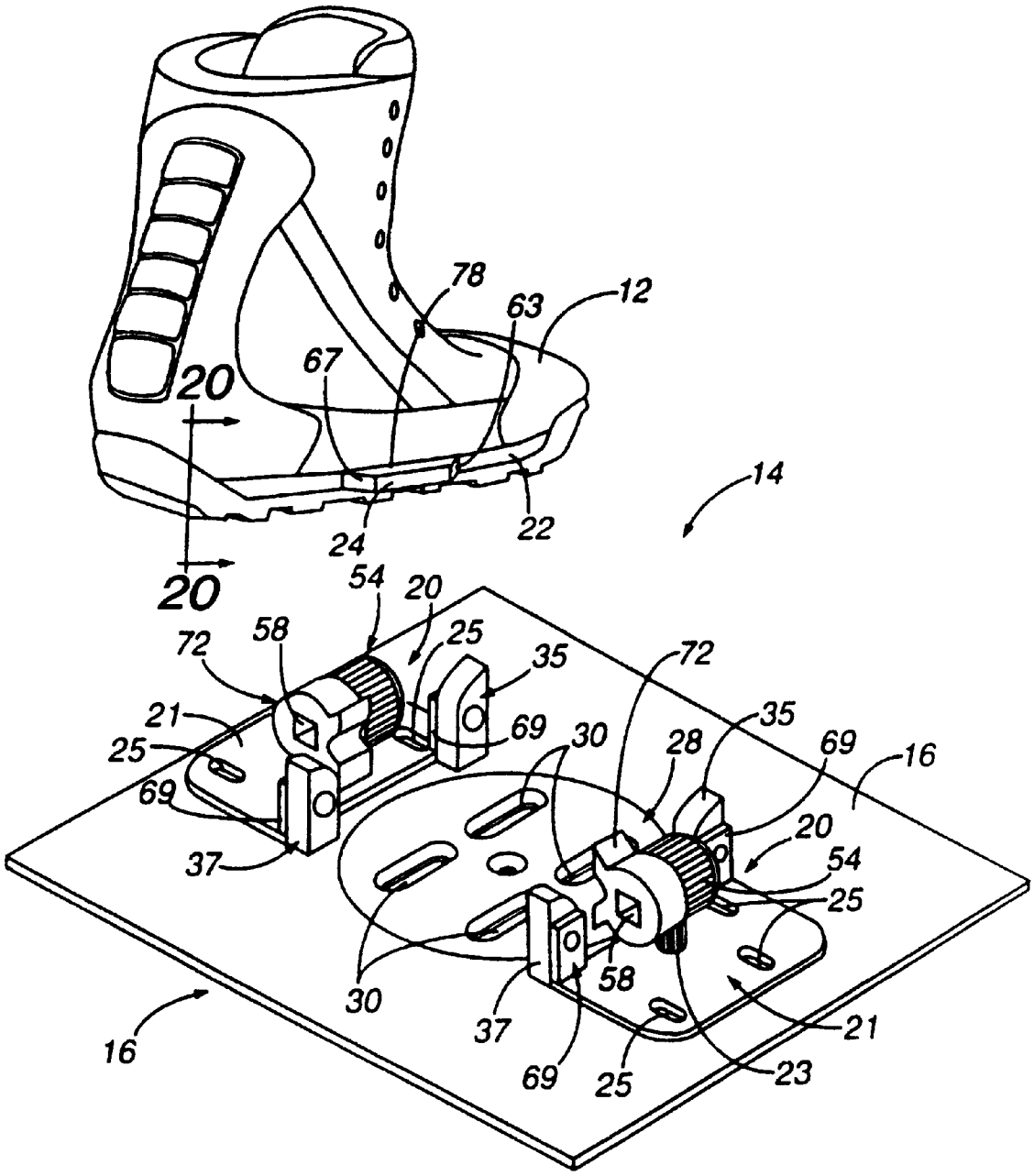
FIG. 1 is a perspective view of a first preferred embodiment of the boot and binding assembly of the present invention.

Turning now to the drawings, FIGS. 1–6 depict a first preferred embodiment of the binding assembly 14 of the present invention. As best shown in FIG. 1, the binding assembly 14 includes a boot 12 and a binding plate 16. In use, the binding plate 16 is mounted on the top surface of a snowboard (not shown).

As described below in greater detail, the binding plate 16 includes a pair of "ratcheting" binding elements 20 supported above a baseplate 21 by means of a support post or column 23. The baseplates 21 are preferably mounted to the binding plate 16 by means of countersunk T-bolts and/or Allen bolts disposed through a plurality of slots 25 therein. Alternately, instead of T-bolts or Allen bolts, any suitable type of fastener may be used. The slots 25 allow the baseplates 21 to be adjusted on the binding plate 16 to accommodate boots having varying widths.

Figure 2:
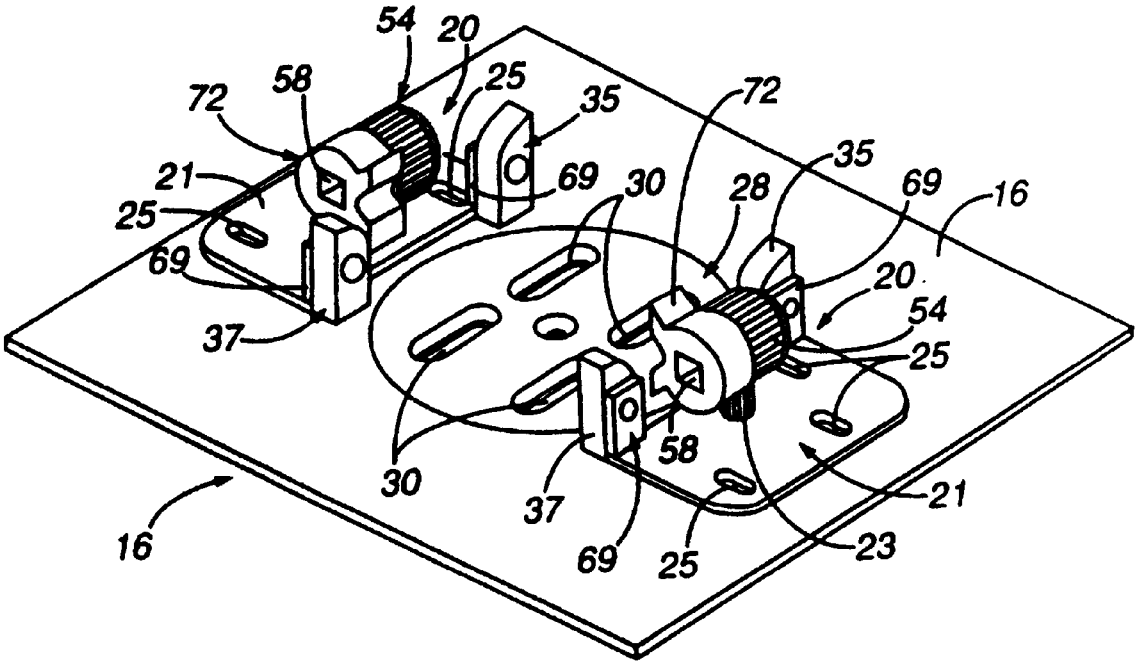
FIG. 2 is a perspective view of the binding plate shown in FIG. 1.
Figures 3A, 3B:
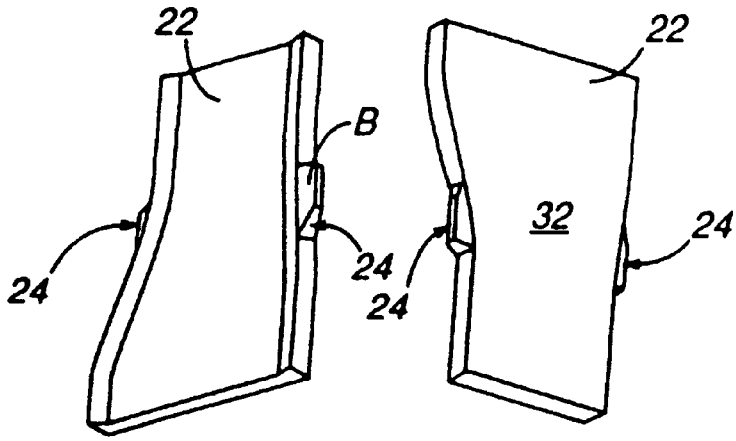
FIG. 3*a* is a first perspective view of the boot plate shown in FIG. 1.
FIG. 3*b* is a second perspective view of the boot plate shown in FIG. 1.

As shown in FIGS. 1 and 2, the binding plate 16 also includes an adjusting disk 28. The adjusting disk 28 includes a number of slots 30 therein to adjust the transverse and angular positions of the binding plate 16 on the snowboard. The transverse adjustment feature is utilized to compensate for the differing feet length of individual snowboarders.

After the transverse position of the binding plate 16 is determined, the binding plate 16 is rotated with respect to the adjusting disk 28 to the angular position desired for the binding plate 16 on the snowboard. Subsequently, the adjusting disk 28 is tightly secured to the snowboard, as by bolts or other suitable connectors, to securely fasten the binding plate 16 to the snowboard.

As shown in FIGS. 1 and 3–6, the boot 12 includes a preferred embodiment of the boot plate 22. Preferably, the boot plate 22 includes a pair of opposing, horizontally-projecting binding tabs 24. Each of the binding tabs 24 includes a top edge 78, and is positioned to engage and mate with a binding element 20 located on a respective binding plate 16.

Figure 4:
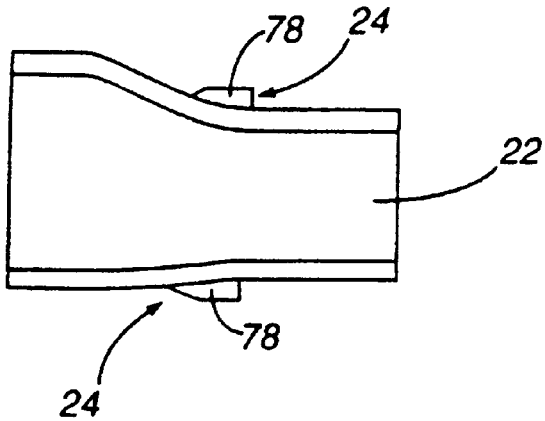
FIG. 4 is a plan view of the boot plate shown in FIG. 3*a*.
Figure 5:
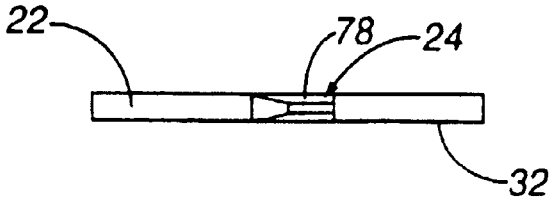
FIG. 5 is a side view of the boot plate shown in FIGS. 3*a*, 3*b* and 4.

The embodiment of the boot plate 22 shown in FIGS. 3–5 may be used as a midsole for the boot 12 shown in FIG. 1. Although it is not depicted in FIGS. 3, 5 and 6, an outsole may be adhesively secured to the bottom surface 32 of the boot plate 22.

As shown and described above, a first preferred embodiment of the present invention provides a two point or "bi" binding assembly (e.g., corresponding to the two binding elements 20 on a binding plate 16 or the two binding tabs 24 on a boot plate 22) for mounting the boot 12 to a snowboard. The two binding tabs 24 are positioned at approximately the mid-point of the boot between the toe and the heel thereof. Since this embodiment of the binding assembly 14 has only two binding points, and therefore only two friction points to overcome, it is believed that the binding tabs 24 will be easily engaged with the binding elements 20. Further, as contrasted with the effort required to adjust four or more binding elements, it will be less difficult to adjust the position of only two binding elements 20 to accommodate boots of different sizes.

Figure 6A:
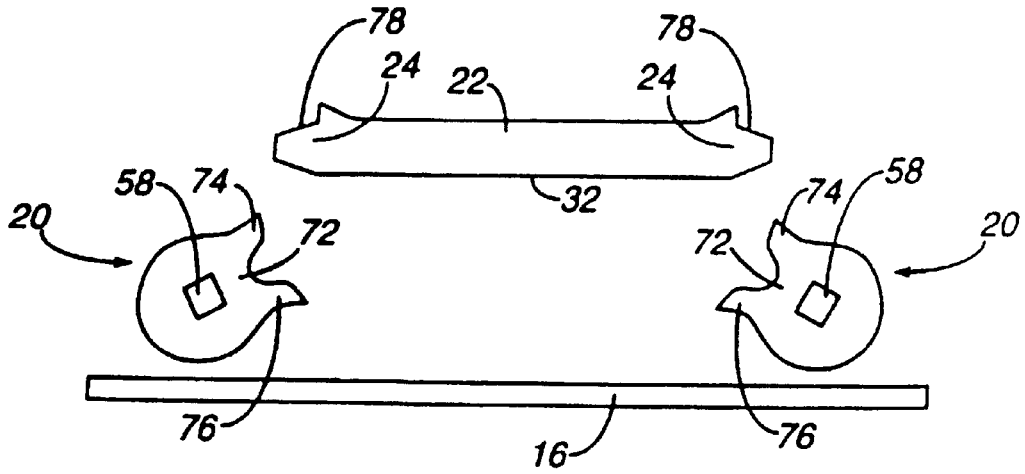
FIGS. 6*a*–6*c* are various operational views of the first preferred embodiment of the binding assembly showing the binding tabs of the boot plate engaging the binding elements of the binding plate.
Figure 6B:
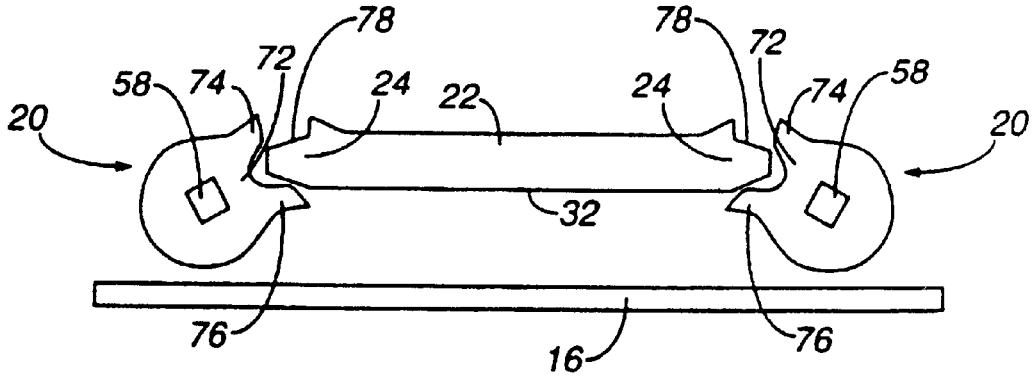
Figure 6C:
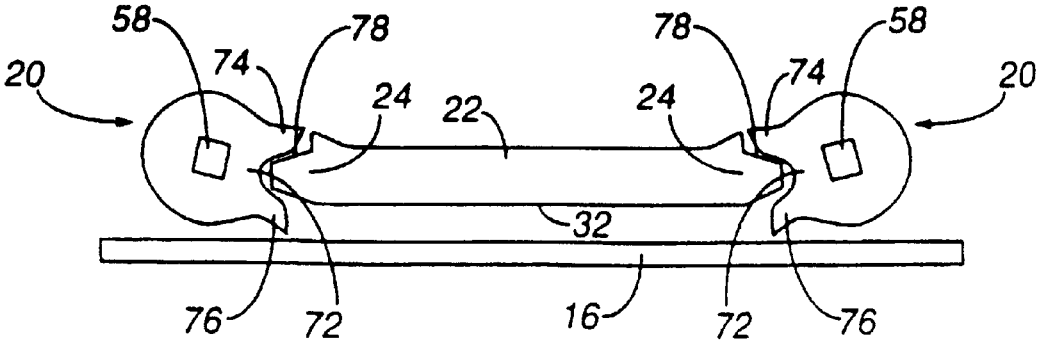
Figure 7:
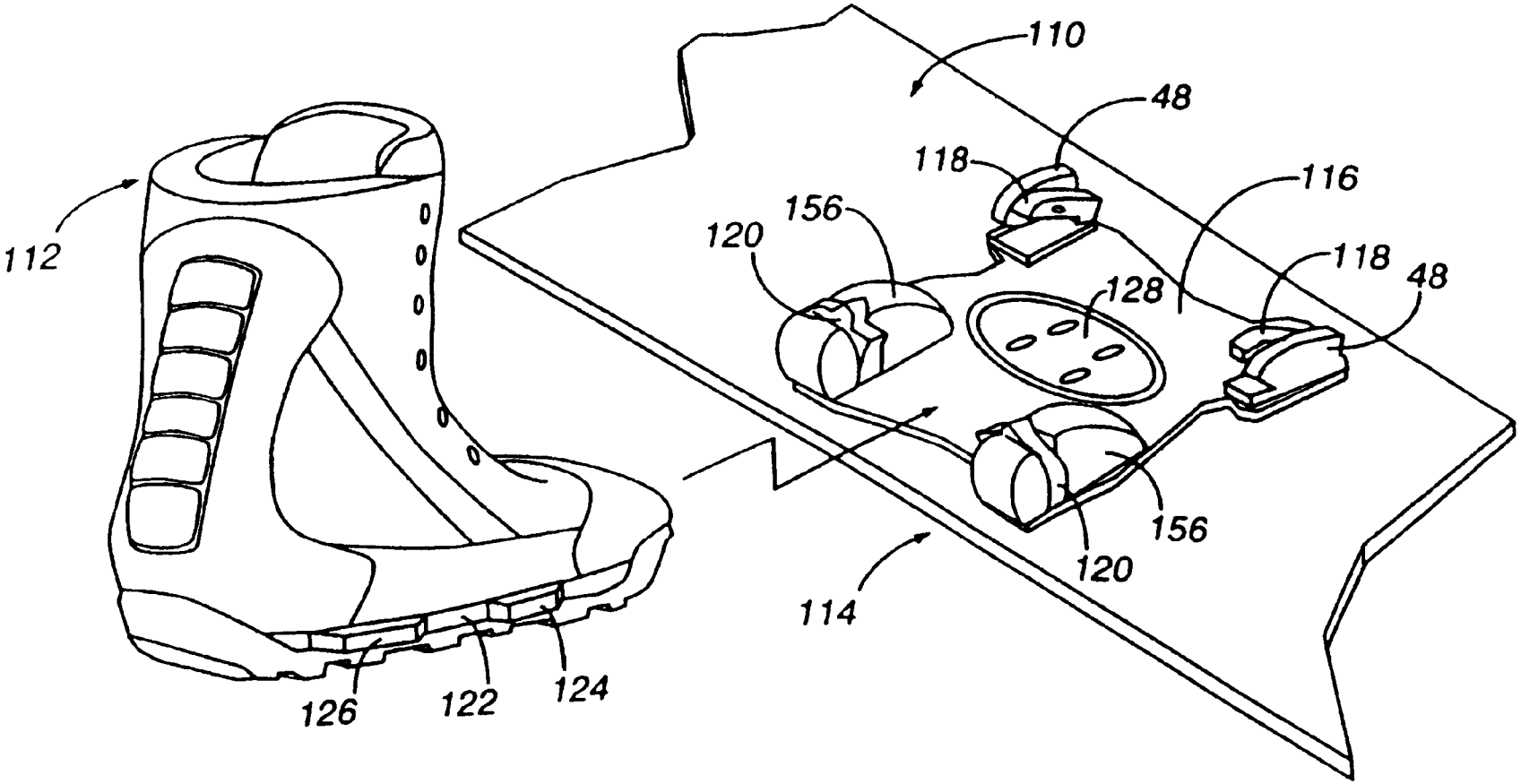
FIG. 7 is a perspective view of a second preferred embodiment of the boot and binding assembly of the present invention.
Figure 8:
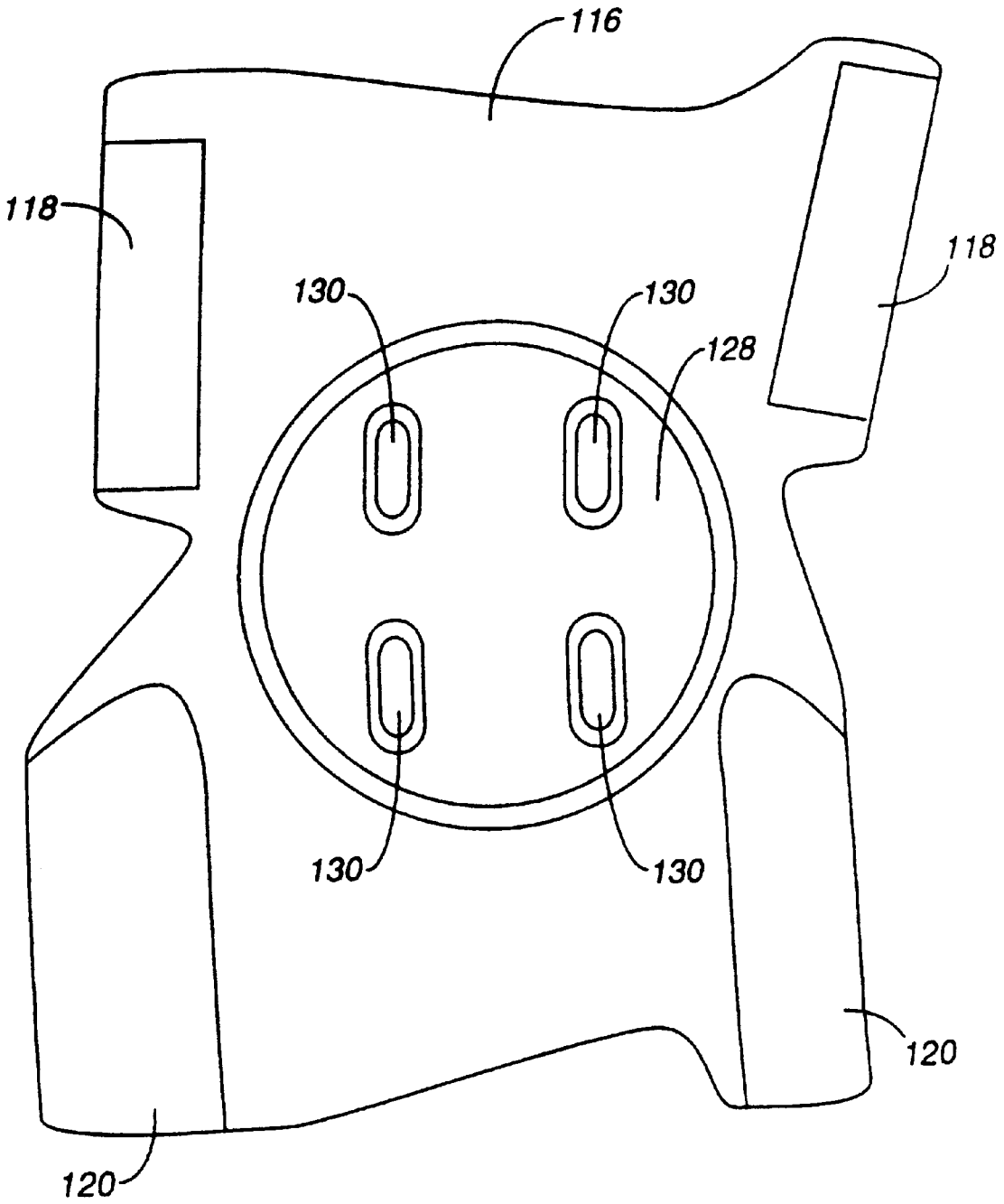
FIG. 8 is a plan view of the binding plate shown in FIG. 7.

As best shown in FIGS. 6*a*–6*c*, which depict the structure and operation of the binding elements 20 and the binding tabs 24, each of the binding elements 20 includes a member having a recess 72 adapted to receive and capture a respective binding tab 24. Preferably, the recessed member 72 of each binding element 20 is rotatably connected via a shaft 58 to a ratchet-and-pawl combination 54 mounted adjacent thereto. As shown, each recessed member 72 forms an upper flange 74 and a lower flange 76 at the extreme edges thereof.

Alternately, instead of a ratchet-and-pawl combination 54, any suitable rotational one-way locking device can be used in the present invention, including, for example, a cam-lock device.

When the binding tabs 24 of the boot plate 22 engage the lower flanges 76 of the recessed members 72, the ratchet-and-pawl combinations 54 (see FIGS. 1 and 2) allow the recessed members 72 to rotate. As the recessed members 72 rotate, the upper flanges 74 of the recesses 72 rotate into position above the top edges 78, thereby capturing the binding tabs 24 within the recesses 72. Because the pawls hold the ratchets in place such that they cannot be loosened, the binding elements 20 will securely maintain the binding tabs 24 of the boot plate 22 in the binding assembly 14.

A manually-actuated lever (not shown) is attached to the pawls of the ratchet-and-pawl combinations 54 of one or both of the binding elements 20 to engage and disengage the pawls from the ratchets. By disengaging the pawls from the ratchets, an upward force on the boot 12 will rotate the binding elements 20 and release the binding tabs 24 therefrom.

Further, the ratchets of the binding elements 20 can tighten during snowboard use due to, for example, outsole compression, or the compression of any contaminants (i.e., dirt and snow) during downward loading. Therefore, the binding assembly of the present invention does not loosen during use but, instead, provides a ratchet-and-pawl mechanism that actually tightens the grip of the binding assembly on the boot during snowboarding.

In a preferred embodiment, each recessed member 72 is shaped to define an involute curve and each binding tab 24 defines a pressure angle B (see FIG. 3) in the range of about 20–25°. As a recessed member 72 is rotated, the involute curve presents a surface that is substantially normal to the top edge 78 of the respective binding tab 24. This feature operates to direct the forces imparted by the binding tabs 24 on the binding elements 20 in one direction, thereby practically eliminating the introduction of other force loads, such as shear loads.

In addition, each of the binding elements 20 includes front and rear stops 35, 37 supported on the baseplates 21 by means of support flanges 69 mounted thereto. The stops 35, 37 engage the leading edges 63 and the following edges 67, respectively, of the binding tabs 24 (see FIGS. 1 and 2), and function to keep the boot 12 from sliding in a frontward and/or rearward direction in the binding assembly 14.

FIGS. 7–15 depict a second preferred embodiment of the boot and binding assembly 114 of the present invention. As shown, a snowboard 110 includes a binding plate 116 mounted on the top surface thereof. As described below, the binding plate 116 includes a front pair of pivotable binding elements 118 and a rear pair of ratcheting binding elements 120. The binding elements 118, 120 are preferably mounted to the binding plate 116 by countersunk T-bolts and/or Allen bolts. Alternately, any other suitable fasteners may be used.

In addition, the boot 112 includes a boot plate 122 having two pairs of opposing, horizontally-projecting binding tabs 124, 126. The front and rear pairs of binding tabs 124, 126 are positioned to engage and mate with the respective front and rear binding elements 118, 120 located on a respective binding plate 116.

As described above with respect to FIGS. 1 and 2, the binding plate 116 also includes a disk 128 for adjusting the transverse and angular orientations of the plate 116 on the snowboard 110.

Figure 9:
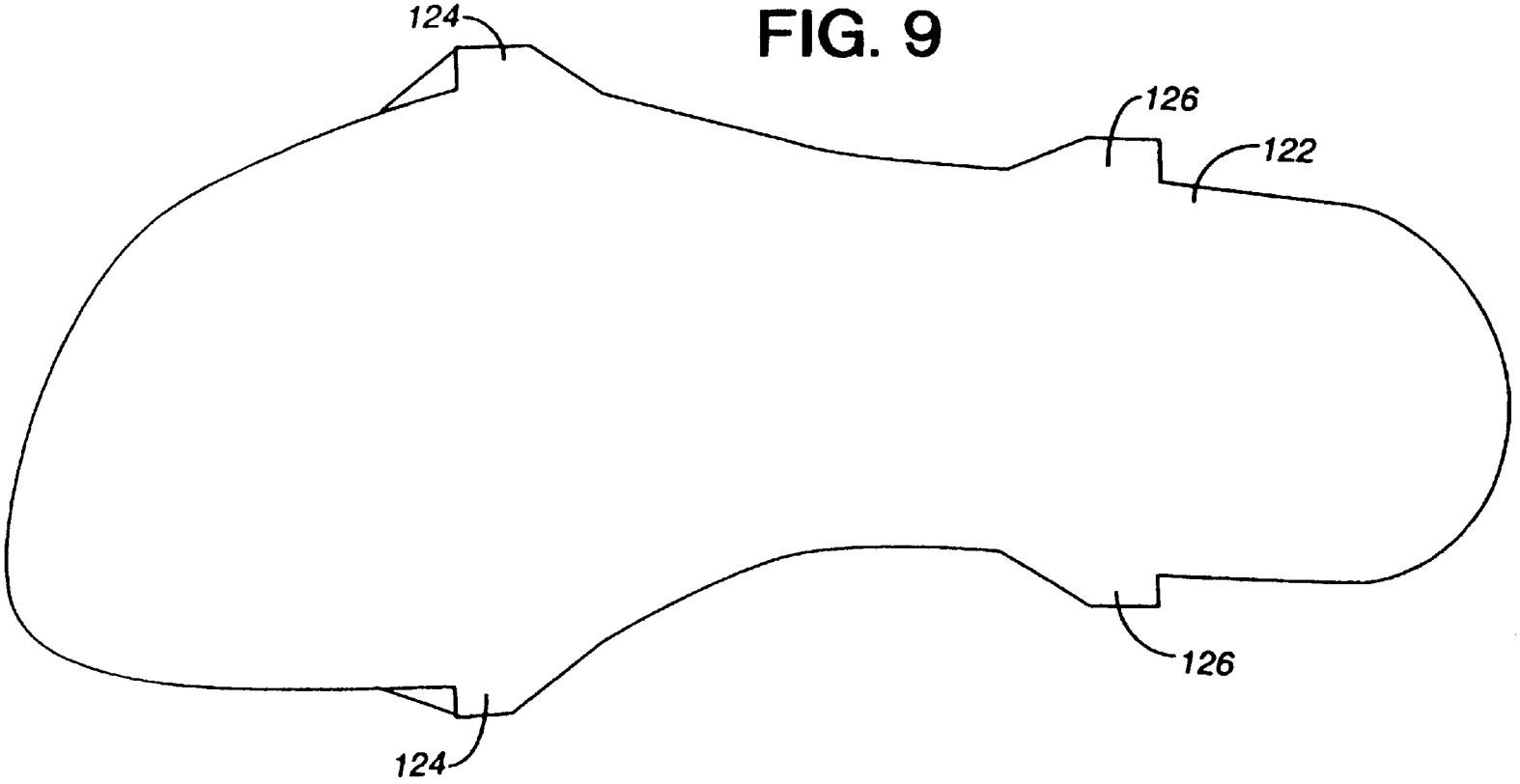
FIG. 9 is a plan view of the boot plate shown in FIG. 7.
Figure 10:
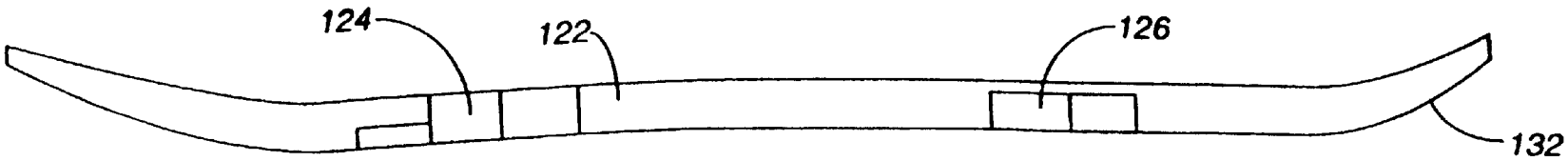
FIG. 10 is a side view of the boot plate shown in FIG. 9.

As shown in FIGS. 9 and 10, a preferred embodiment of the boot plate 122 includes two oppositely-disposed front binding tabs 124 and two oppositely-disposed rear binding tabs 126. The front and rear pairs of binding tabs 124, 126 are positioned to engage and mate with the respective front and rear binding elements 118, 120 located on a respective binding plate 116.

As can be seen, the structures of the front and rear binding tabs 124, 126 differ from one another. The reason for this structural difference will be discussed in detail below. Further, the embodiment of the boot plate 122 shown in FIGS. 9 and 10 may be used as a midsole for the boot 112 shown in FIG. 7. Although it is not depicted in FIG. 10, an outsole may be adhesively secured to the bottom surface 132 of the boot plate 122.

Figure 11:
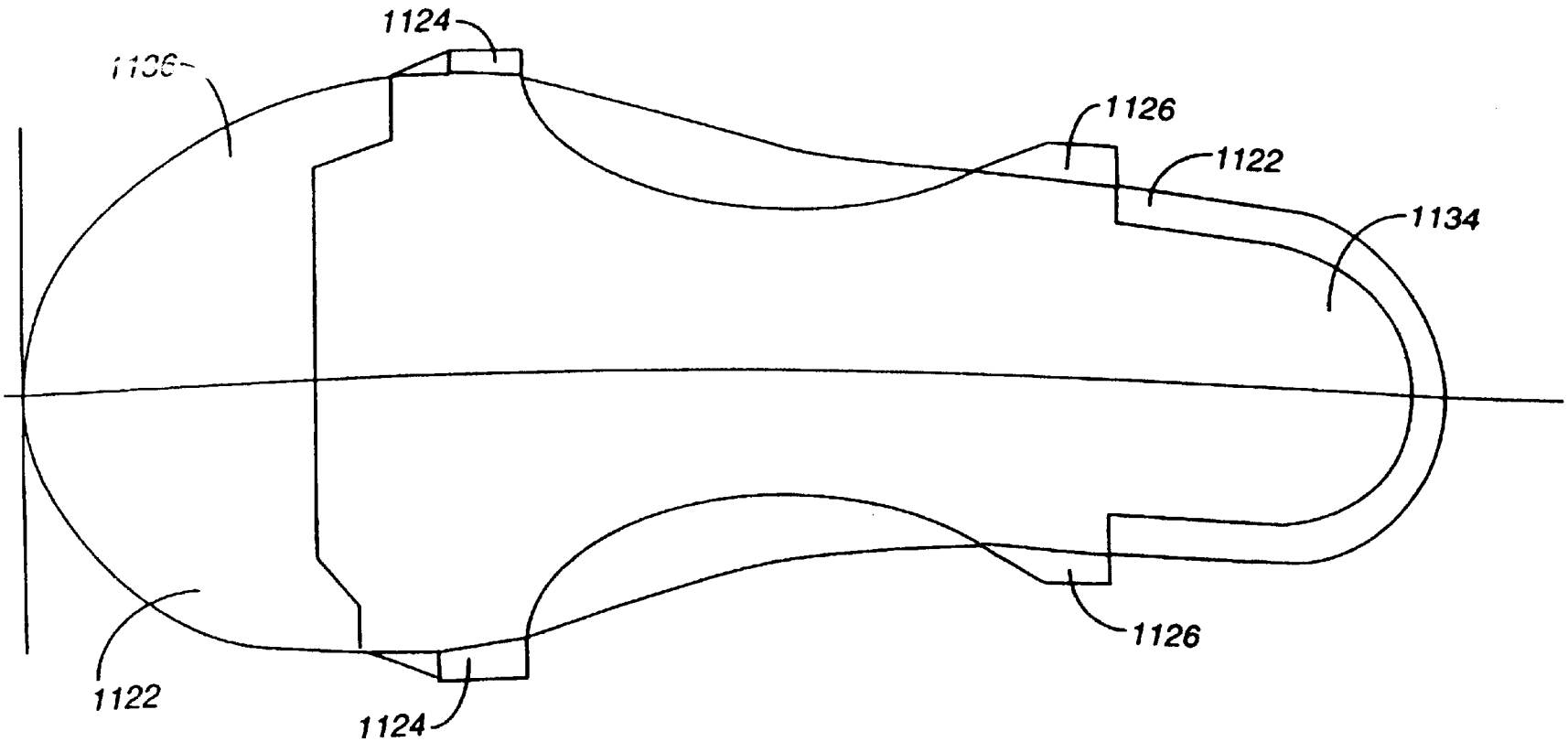
FIG. 11 is a plan view of an alternate embodiment of the boot plate shown in FIGS. 7, 9 and 10.
Figure 12:
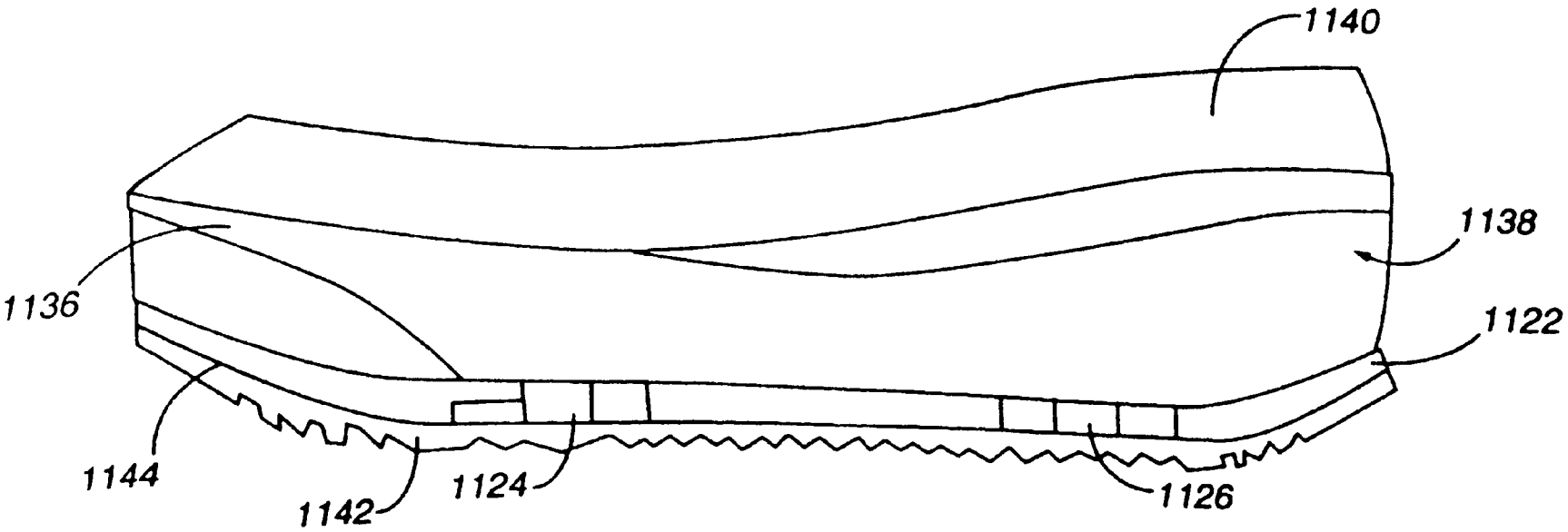
FIG. 12 is a side view showing the boot plate depicted in FIG. 11 and an upper boot shell formed on the boot plate.

As shown in FIGS. 11 and 12, an alternate embodiment of the boot plate 1122 includes an insert 1134 and a shell 1136. The shell 1136 comprises the remaining portion of the boot plate not encompassed by the insert 1134 and, as best shown in FIG. 12, also includes the upper shell portion 1138 that extends above the boot plate 1122. The front and rear binding tabs 1124, 1126 of the boot plate 1122 are integrally formed with the insert 1134, and are preferably identical in size to the respective binding tabs 124, 126 shown in FIGS. 9 and 10.

The boot plate 1122 and the shell 1136 shown in FIGS. 11 and 12 are preferably formed from a dual injection molding process. Specifically, the insert 1134 (and thus the respective binding tabs 1124, 1126) is formed in a first mold from a relatively hard material. The resulting insert 1134 is then placed in a second mold, and a second, more flexible, material is injected around the insert 1134 to form the shell 1136. A hard material is needed to form the insert 1134 so that it will be able to withstand the loads transmitted by the snowboard 110 to the binding assembly 114. Contrariwise, the shell 1136 is desired to be formed from a softer material to provide the remaining portion of the boot 112 with greater flexibility. Preferably, polyurethane having differing durometers is used to form the insert 1134 and the shell 1136.

Further, as shown in FIG. 12, an outsole 1142 may be secured to the bottom surface 1144 of the boot plate 1122. Moreover, the upper portion (not shown) of the boot 112 may be sewn or otherwise attached to the leading edge 1140 of the upper shell portion 1138 to complete the boot 112.

For purposes of clarity, only the boot plate 122 will be discussed below to describe the second preferred embodiment of the boot and binding assembly 114 of the present invention. However, it should be understood that the remaining portions of the boot 112, including the outsole and the upper portion, would actually be included in the application of the present invention.

As shown and described above, a second preferred embodiment of the present invention includes four binding points (e.g., corresponding to the four binding elements 118, 120 on a binding plate 116 or the four binding tabs 124, 126 on a boot plate 122) for mounting the boot 112 to a snowboard 110.

The four binding points are positioned around the periphery of the boot 112 at those locations where the boot 112 most tightly grips a person's foot. By placing the binding points as shown, the forces encountered by the snowboard 110 will be optimally distributed to the binding assembly 114 and the boot 112 will be stabilized on the snowboard 110. Further, while the use of two or four binding points is discussed herein, it is specifically contemplated that a fewer or greater number of binding points (e.g., 1,3,5 or 6) may be used. For example, a binding plate having a single "toe" binding element and a single "heel" binding element, such as the binding configuration commonly associated with skis, may be utilized.

The structure and operation of the front binding elements 118 and the front binding tabs 124 are best described by reference to FIGS. 13*a*–13*c* and 14. For ease of reference, only one side of the binding assembly 114 will be described below.

As shown in FIGS. 13*a*–13*c* and 14, the front binding element 118 is connected to a first housing 148 by a shaft 146. The front binding element 118 may be formed with a pin (not shown) that rides within a slot formed in the first housing 148. In addition, the rear binding element 120 is rotatably connected via a shaft 158 to a ratchet-and-pawl combination 154. As described above, the boot plate 122 includes front and rear binding tabs 124, 126.

Figure 13A:
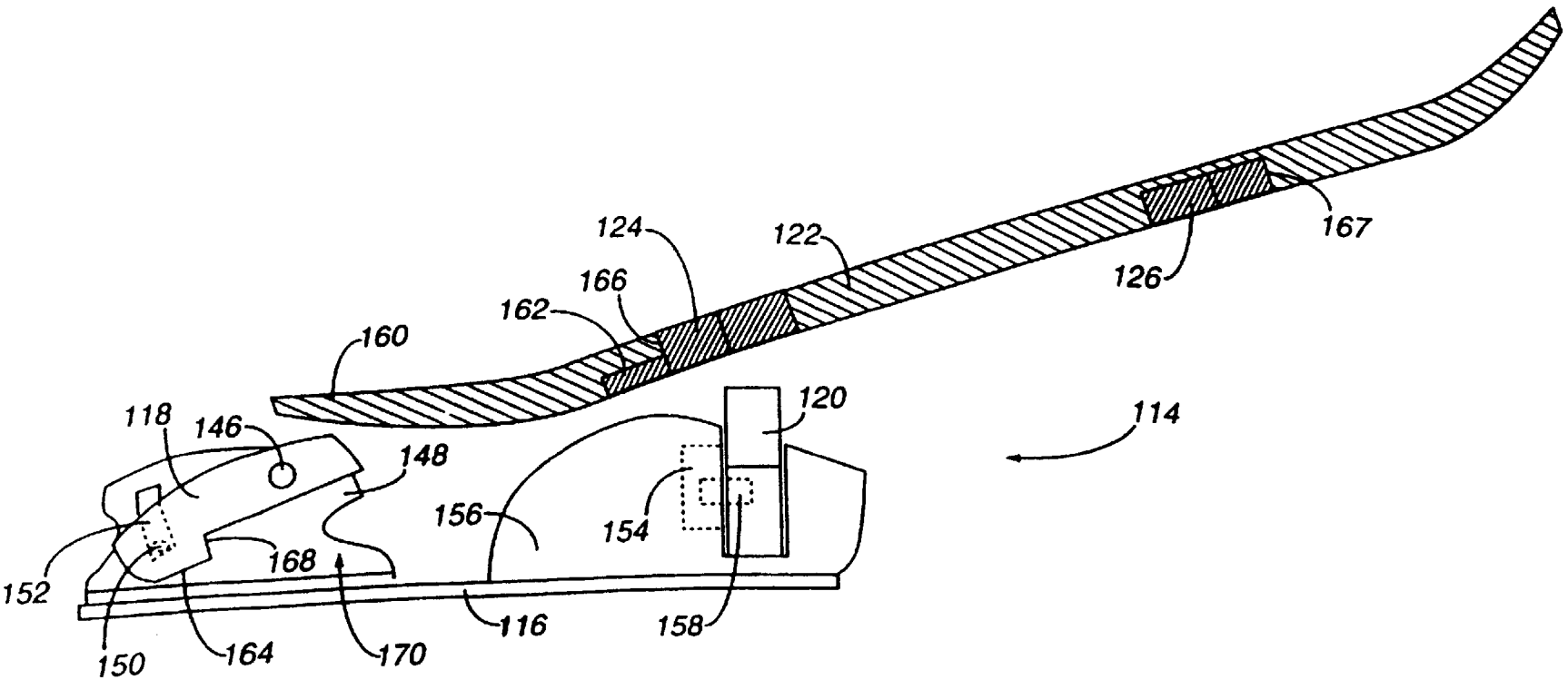
FIGS. 13*a*–13*c* are various operational views of the second preferred embodiment of the binding assembly shown in FIG. 7 depicting the binding tabs of the boot plate engaging the binding elements of the binding plate.

As best shown in FIG. 13*a,* because the present invention provides a "step-in" binding assembly 114, the boot plate 122 addresses the binding plate 116 at an inclined angle. As progressively shown in FIGS. 13*a*–13*c,* the front end 160 of the boot plate 122 is inserted within the binding plate 116 until the front binding tab 124 engages the front binding element 118. Eventually, the leading edge 162 of the front binding tab 124 engages a lower edge 164 of the front binding element 118.

When the shoulder 166 defined in the binding tab 124 fully engages the shoulder 168 defined in the recessed area 170 (see FIGS. 13*a* and 14) of the binding element 118, the binding element 118 is pivoted to its fully extended position and the binding tab 124 is fully seated in the binding element 118. Further, at this position, the pin 150 is urged against the top of the slot 152. When the binding tab 124 is fully seated, the upward forces acting on the pivot point 146 and the pin 150 are transmitted to the binding plate 116, which causes the rear of the snowboard 110 to move upwardly toward the heel of the boot 112, thereby facilitating the completion of the binding operation. As can be perceived, any force exerted on the binding element 118 by the boot 112 will be carried by both the pivot point 146 and the pin 150.

Figure 14:
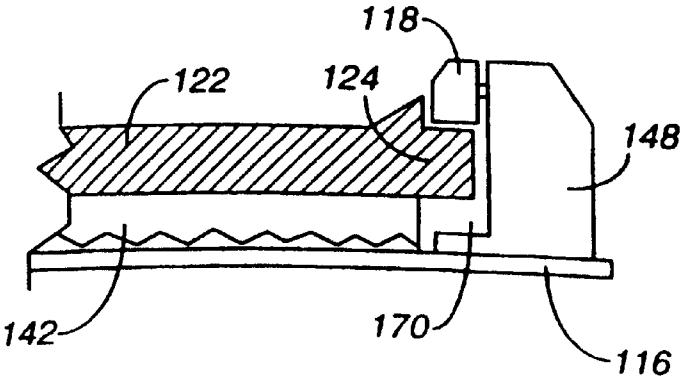
FIG. 14 is a partial cross-sectional view taken along line 14—14 of FIG. 13*c* showing the engaged position of the front binding tab and the front binding element.

As best shown in FIG. 14, the front binding element 118 is preferably pivoted at an angle of approximately 90 degrees to the binding plate 116. However, it is specifically contemplated that the front binding element 118 may be pivoted at any suitable angle between 45 and 90 degrees.

Figure 13B:
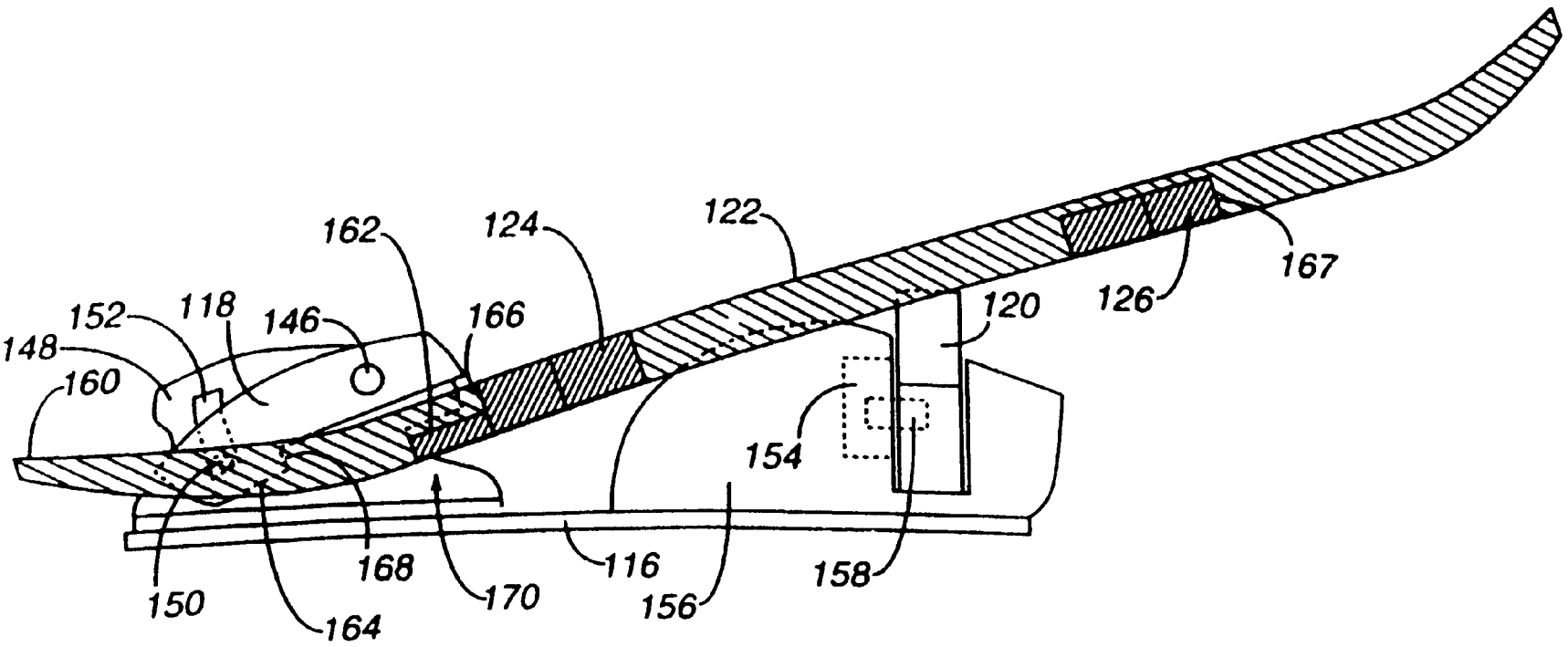
Figure 13C:
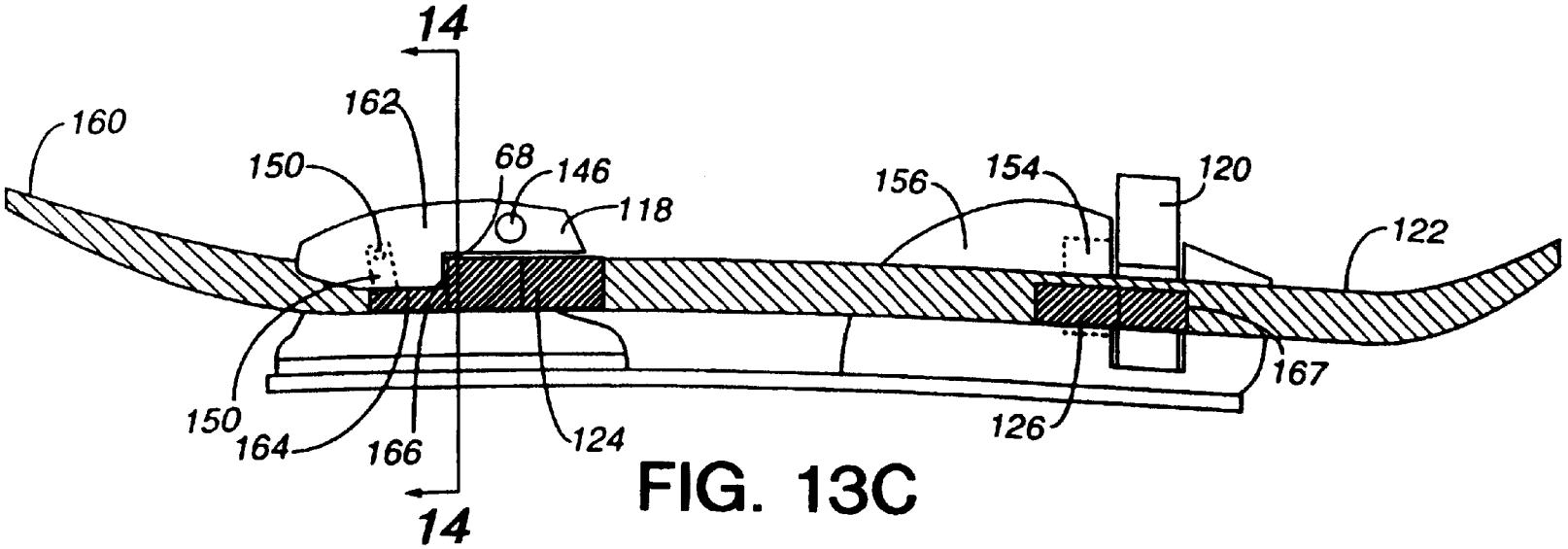

As illustrated in FIGS. 13*a*–13*c,* after the front binding tab 124 engages the front binding element 118, the rear binding tab 126 is urged into engagement with the rear binding element 120. As discussed above, the rear binding element 120 is "ratcheted." Therefore, after the rear binding element 120 captures the rear binding tab 126, the ratchet-and-pawl combination 154 will securely maintain the rear binding tab 126 within the rear binding element 120.

Figure 15A:
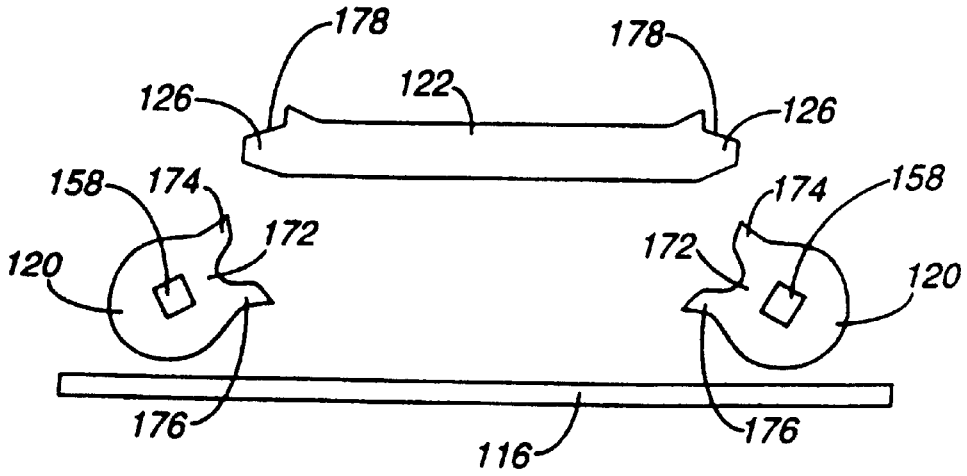
FIGS. 15*a*–15*c* are various operational views (similar to FIGS. 6*a*–6*c*) of the second preferred embodiment of the binding assembly shown in FIG. 7 depicting the rear binding tabs of the boot plate engaging the rear binding elements of the binding plate.
Figure 15B:
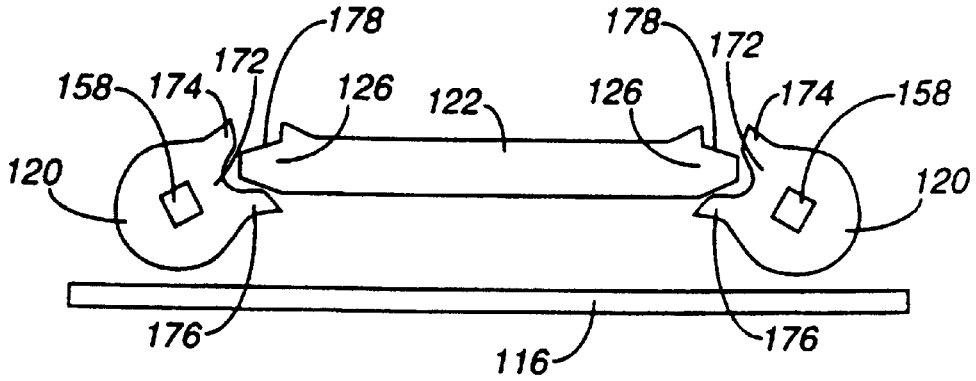
Figure 15C:
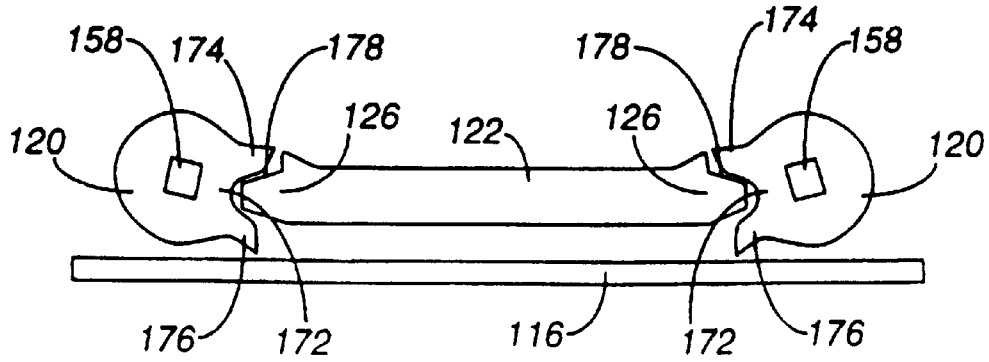

As best shown in FIGS. 15*a*–15*c* (which depict only the structure and operation of the rear binding elements 120 and the rear binding tabs 126), each of the rear binding elements 120 includes a recess 172 adapted to receive and capture a respective rear binding tab 126. Each recess 172 forms an upper flange 174 and a lower flange 176 at the extreme edges thereof.

When the rear binding tabs 126 of the boot plate 122 engage the lower flanges 176 of the recesses 172, the ratchet-and-pawl combinations 154 (see FIGS. 13*a*–13*c*) allow the rear binding elements 120 to rotate. As the rear binding elements 120 rotate, the upper flanges 174 of the recesses 172 rotate into position above the top edges 178, thereby capturing the rear binding tabs 126 within the recesses 172.

Because the pawls hold the ratchets in place such that they cannot be loosened, the rear binding elements 120 will securely maintain the rear binding tabs 126 of the boot plate 122 in the binding assembly 114.

A manually-actuated lever (not shown) is attached to the pawls of the ratchet-and-pawl combinations 154 of one or both of the rear binding elements 120 to engage and disengage the pawls from the ratchets. By disengaging the pawls from the ratchets, an upward force on the boot 112 will rotate the rear binding elements 120 and release the rear binding tabs 126 therefrom.

As discussed above, the ratchets of the rear binding elements 120 can tighten during snowboard use due to, for example, outsole compression, or the compression of any contaminants (i.e., dirt and snow) during downward loading.

For the reasons stated above, each recess 172 is shaped to define an involute curve. As explained above, this feature operates to direct the forces imparted by the rear binding tabs 126 on the rear binding elements 120 in one direction, thereby practically eliminating the introduction of other force loads, such as shear loads.

For the rear binding tabs 126 to properly engage the surface of the involute curve as the recessed member 172 rotates, the rear binding tabs preferably are formed with a pressure angle of approximately 20–25°.

In addition, each of the rear binding elements 120 includes an angled block (not shown) that engages the following edge 167 of the rear binding tabs 126 (see FIGS. 13*a*–13*c*). The blocks function to urge the boot plate 122 forward and/or inward toward the center of the binding plate 116 to further seat the boot plate 122 in the binding assembly 114.

Figure 16:
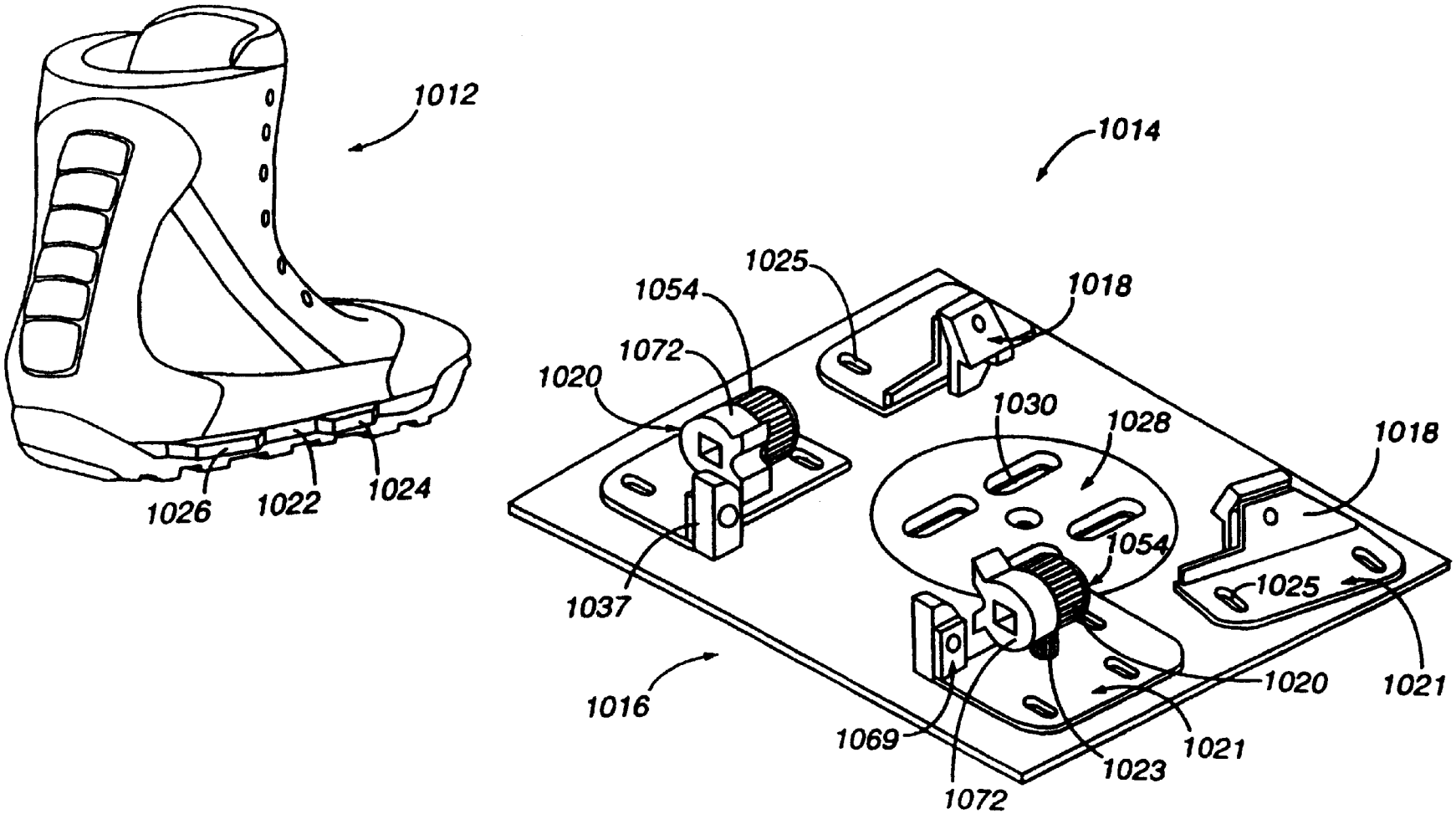
FIG. 16 is a perspective view of a third preferred embodiment of the boot and binding assembly of the present invention.

A third preferred embodiment of the boot and binding assembly 1014 of the present invention is shown in FIG. 16. Like the embodiment depicted in FIG. 7–15, the binding assembly 1014 provides a four point or "quad" binding assembly.

The binding assembly 1014 includes a binding plate 1016 having a front pair of binding elements 1018 and a rear pair of ratcheting binding elements 1020. Each of the rear binding elements 1020 is supported above a baseplate 1021 by means of a support post of column 1023. The baseplates 1021 are preferably mounted to the binding plate 1016 by countersunk T-bolts and/or Allen bolts, or any other suitable fasteners, disposed through slots 1025 therein.

The slots 1025 in the baseplates 1021 are used to adjust the positioning of the binding elements 1018, 1020 to accommodate different boot widths. Further, as discussed above with respect to the first and second preferred embodiments, the binding plate 1016 also includes a disk 1028 for adjusting the transverse and angular orientations of the binding pate 1016 on the snowboard (not shown).

As can be readily perceived, the binding assembly 1014 shown in FIG. 16 incorporates many of the same features shown and described above with respect to the first and second preferred embodiments of the binding assembly 14, 114. The binding assembly 1014, including the front and rear binding tabs 1024, 1026 and the front and rear binding elements 1018, 1020, operates in substantially the same manner as described above with respect to FIGS. 7–15, and reference should be made thereto.

Figure 17:
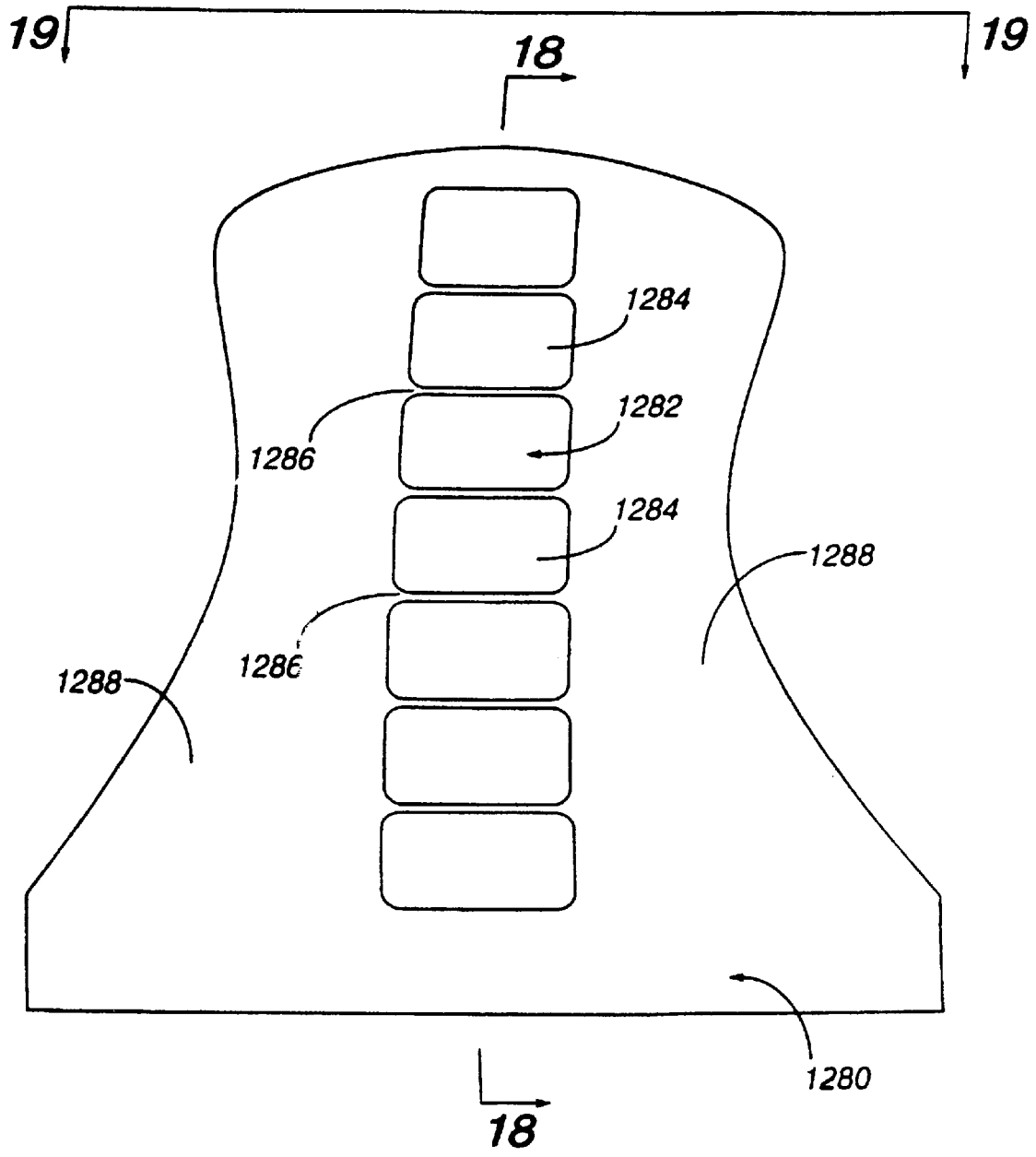
FIG. 17 is an elevational view of a preferred embodiment of the boot internal highback shown in FIGS. 1, 7 and 16.
Figure 19:
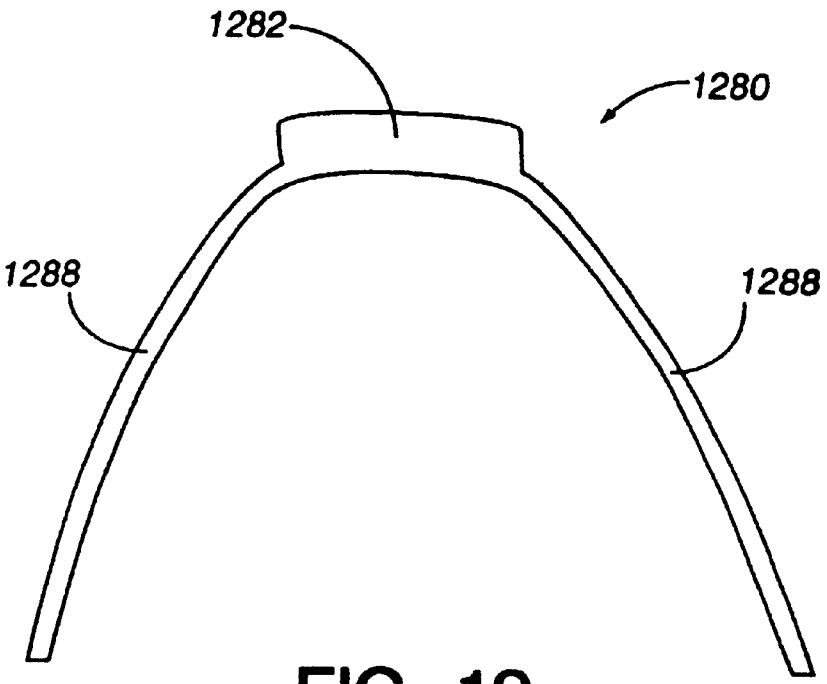
FIG. 19 is a top view taken along line 19—19 of FIG. 17.
Figure 18:
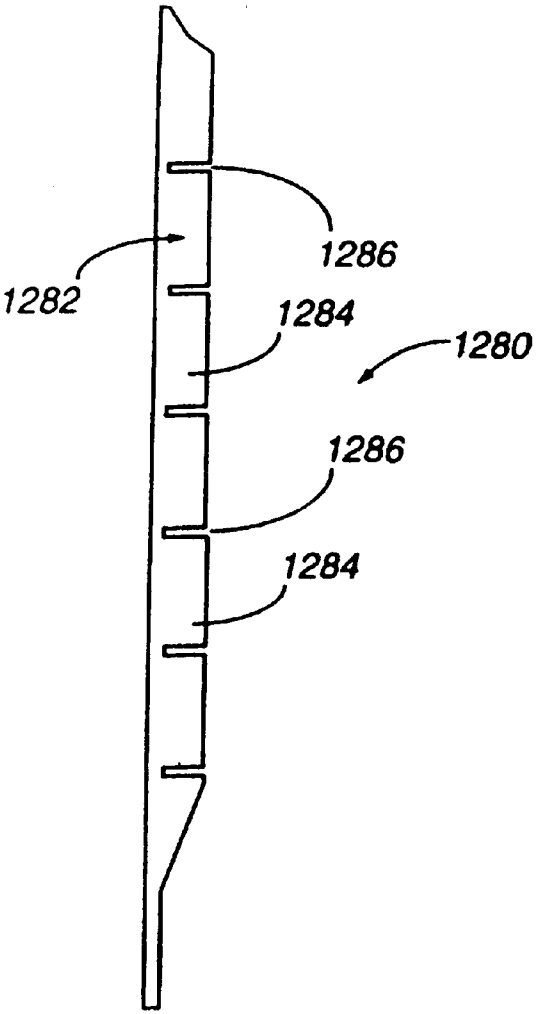
FIG. 18 is a cross-sectional view taken along line 18—18 of FIG. 17.

As best shown in FIGS. 17–19, the internal highback 1280 of the boot 12, 112, 1012 includes a rear backbone 1282 formed of a plurality of substantially polygonal portions or "vertebrae" 1284 separated by shallow channels 1286. As best shown in FIG. 18, if the boot 12, and thus backbone 1282, is required to bend forward or side-to-side, the channels 1286 provide the backbone 1282 with the flexibility to perform that function. However, if rearward bending is attempted (i.e., during a heel turn), the "vertebrae" 1284 interfere with one another to prevent substantial rearward bending of the backbone 1282. In addition, two substantially flexible flange portions 1288 are connected to the backbone 1282 and curve toward the interior of the boot 12.

Further, the backbone 1282 is secured to the boot 12 by stitching and/or riveting. In addition, a diagonal nylon strap (not shown) may be connected between the flange portions 1288 and the boot 12 for added backbone support.

Figure 20:
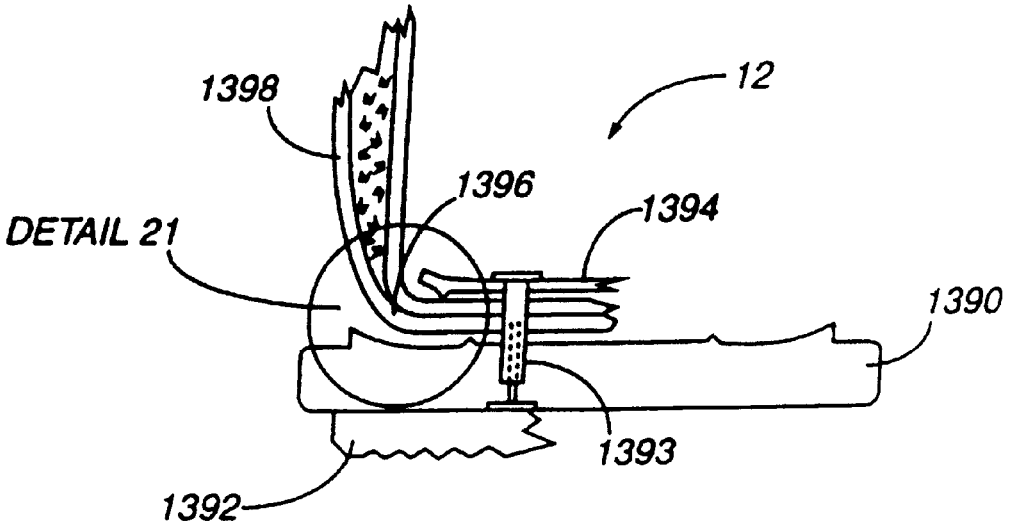
FIG. 20 is a cross-sectional view taken along line 20—20 of FIG. 1.
Figure 21:
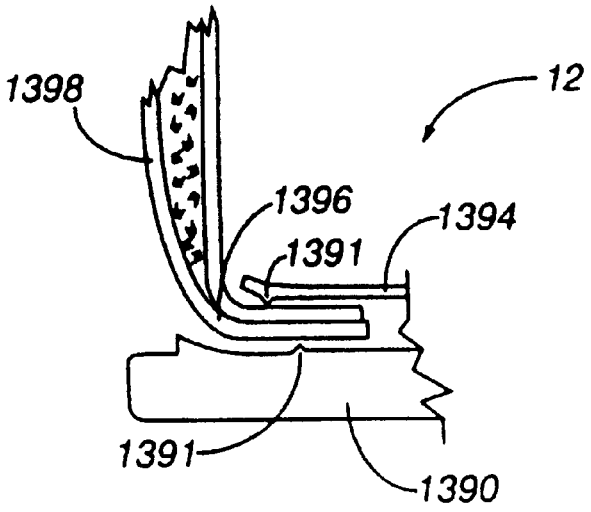
FIG. 21 is an enlarged view of detail 21 shown in FIG. 20.

As shown in FIGS. 20 and 21, a preferred embodiment of the boot 12 includes a midsole 1390, an outer sole 1392 secured (preferably by an adhesive, screws and/or rivets) to the midsole 1390, an internal midsole 1394 secured to the midsole 1390, and a lasting margin 1396 of the upper portion 1398 of the boot 12 captured between the internal midsole 1394 and the midsole 1390. As best shown in FIG. 21, to secure the lasting margin 1396, the internal midsole 1394 and the midsole 1390 each include a ridge 1391. The ridges 1391 are off-set from one another and cooperate to pinch the lasting margin 1396 therebetween. In addition, to further secure the lasting margin 1396, one or more T-bolt assemblies 1393, or other suitable fasteners, may be disposed through the internal midsole 1394 and the midsole 1390.

Figure 22:
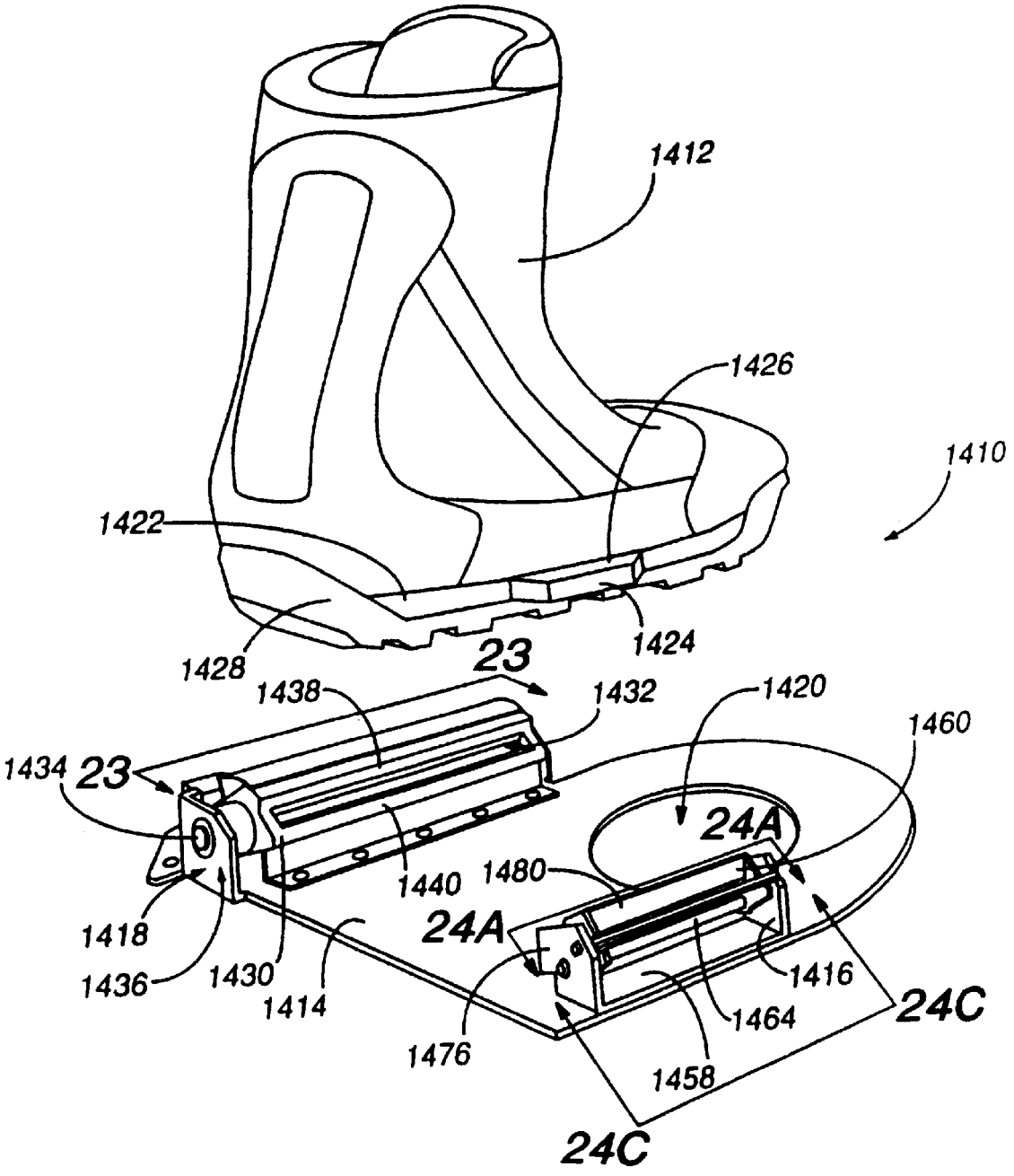
FIG. 22 is a perspective view of a fourth preferred embodiment of the boot and binding assembly of the present invention.

A fourth preferred embodiment of the boot and binding assembly 1410 of the present invention is shown in FIGS. 22–30. As best shown in FIG. 22, the binding assembly 1410 includes a boot 1412 and a binding plate 1414. In use, the binding plate 1414 is mounted on the top surface of a snowboard (not shown).

As described below in greater detail, the binding plate 1414 includes a pair of binding elements 1416, 1418 connected thereto. The binding elements 1416, 1418 may be connected to the binding plate 1414 by any suitable means, including rivets, screws and weldments. In addition, the binding elements 1416, 1418 may be adjustably mounted to the binding plate 1414 to accommodate boots (and therefore feet) of varying width.

Figure 26:
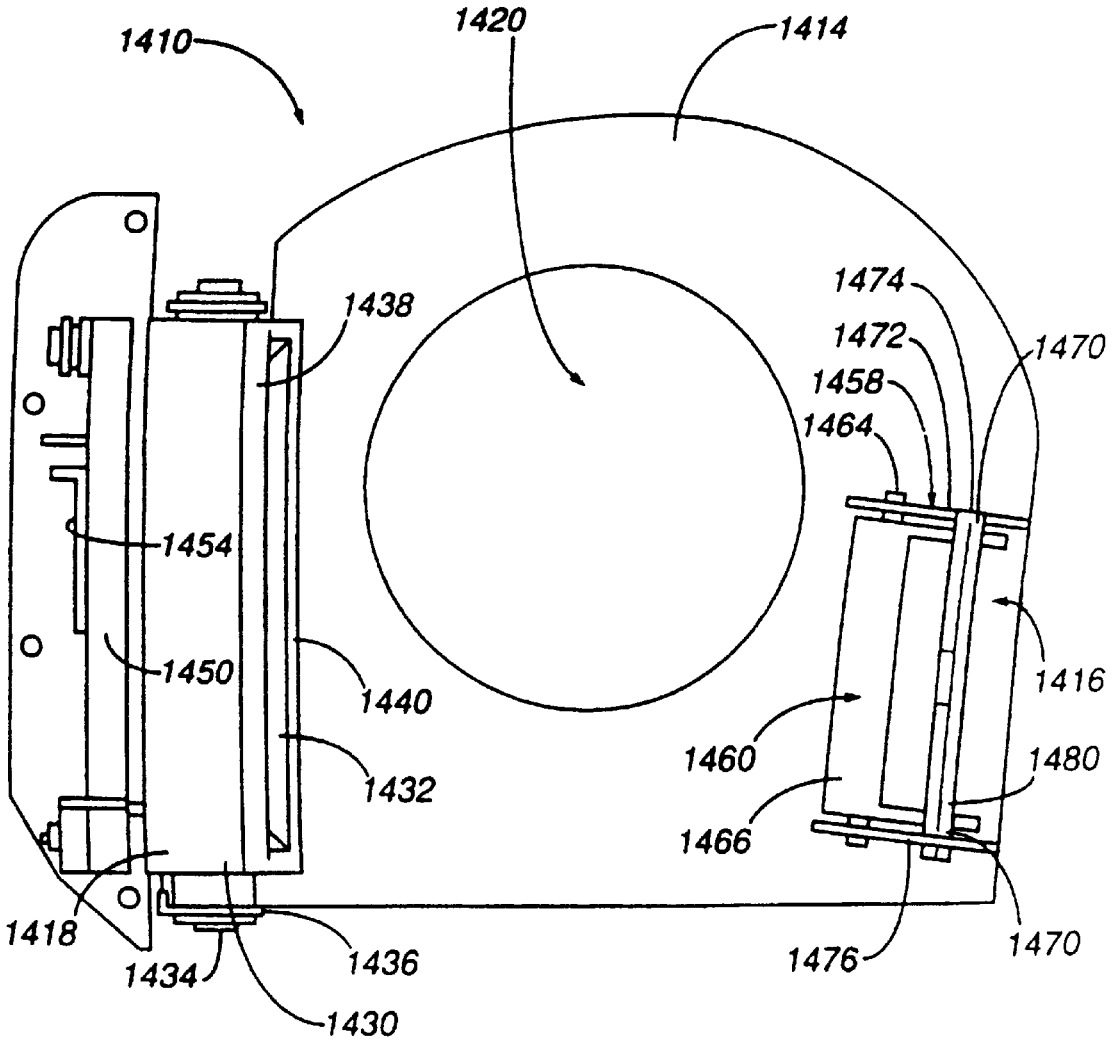
FIG. 26 is a plan view of the fourth preferred embodiment of the present invention showing the outer binding element of the binding assembly in an open position.
Figure 27:
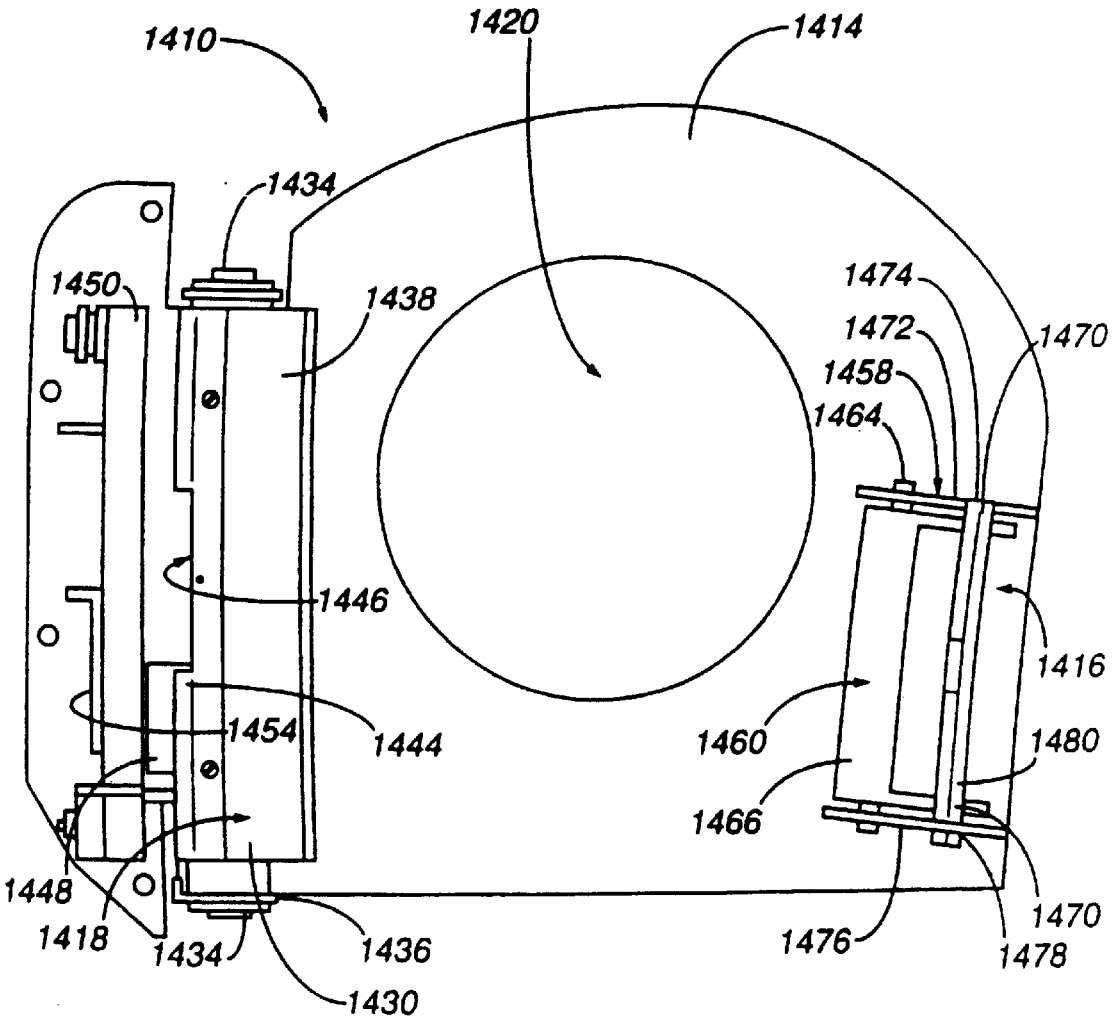
FIG. 27 is a plan view of the fourth preferred embodiment of the present invention showing the outer binding element of the binding assembly in a locked position.

As best shown in FIGS. 22, 26 and 27, the binding plate 1414 also includes an opening 1420 for an adjusting disk (not shown). As described above, the adjusting disk includes a number of slots therein to adjust the transverse and angular positions of the binding plate 1414 on the snowboard.

As shown in FIGS. 22 and 25*a*–25*c*, the boot 1412 includes a boot plate 1422 having a pair of opposing, horizontally-projecting binding tabs 1424. Each of the binding tabs 1424 includes a top and a bottom edge 1426, 1427, and is positioned to engage and mate with a respective binding element 1416, 1418 located on the binding plate 1414.

As shown in FIG. 22, the boot plate 1422 may be used as a midsole for the boot 1412, and an outsole 1428 may be adhesively secured to the bottom surface of the boot plate 1422.

Similar to the first embodiment described above, the fourth embodiment of the present inventions also provides a two point or "bi" binding assembly (i.e., corresponding to the two binding elements 1416, 1418 on the binding plate 1414 or the two binding tabs 1424 on a boot plate 1422) for mounting the boot 1412 to a snowboard. The two binding tabs 1424 are positioned at approximately the mid-point of the boot 1412 between the toe and the heel thereof. Because the binding assembly 1410 has only two binding points, and therefore only two friction points to overcome, it is believed that the binding tabs 1424 will be easily engaged with the binding elements 1416, 1418. Further, as contrasted with the effort required to adjust four or more binding elements, it will be less difficult to adjust the position of only two binding elements 1416, 1418 to accommodate boots of different sizes.

In the fourth preferred embodiment of the binding assembly 1410 shown in FIGS. 22–30, the outer binding element 1418 rotates from an open to a locked position to secure the boot 1412 to the snowboard. The inner binding element 1416 cooperates with the outer binding element 1418 to secure the boot 1412 to the snowboard.

As best shown in FIGS. 22, 25*a*–25*c*, 26 and 27, an embodiment of the outer binding element 1418 includes a member 1430 having a recess 1432 adapted to receive and capture an outer binding tab 1424 on the boot 1412. As shown, the recess 1432 forms an upper flange 1438 and a lower flange 1440 at the extreme edges thereof. As discussed in more detail below, the flanges 1438, 1440 engage the top and bottom edges 1426, 1427, respectively, of the outer binding tab 1424 of the boot 1412.

The recessed member 1430 is rotatably connected via a shaft 1434 to a support structure 1436, which may be connected to or integrally formed with the binding plate 1414. The shaft 1434 may be secured to the support structure 1436 by any suitable means, including retaining rings.

Figure 23A:
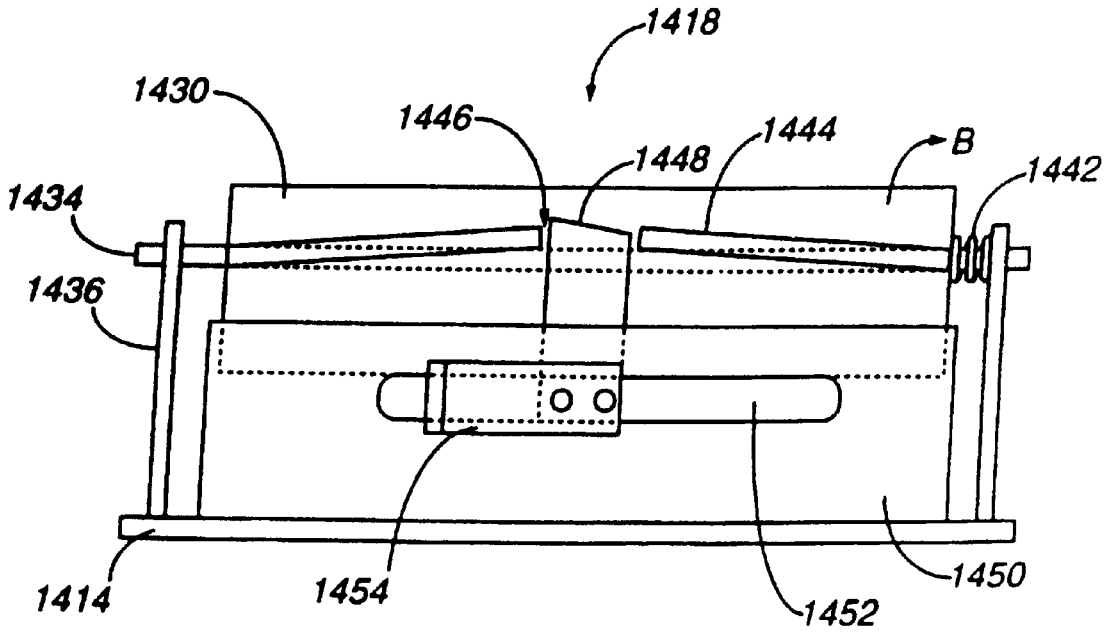
FIG. 23*a* is a rear elevational view taken along line 23—23 of FIG. 22 showing the outer binding element of the binding assembly in an open position.
Figure 23B:
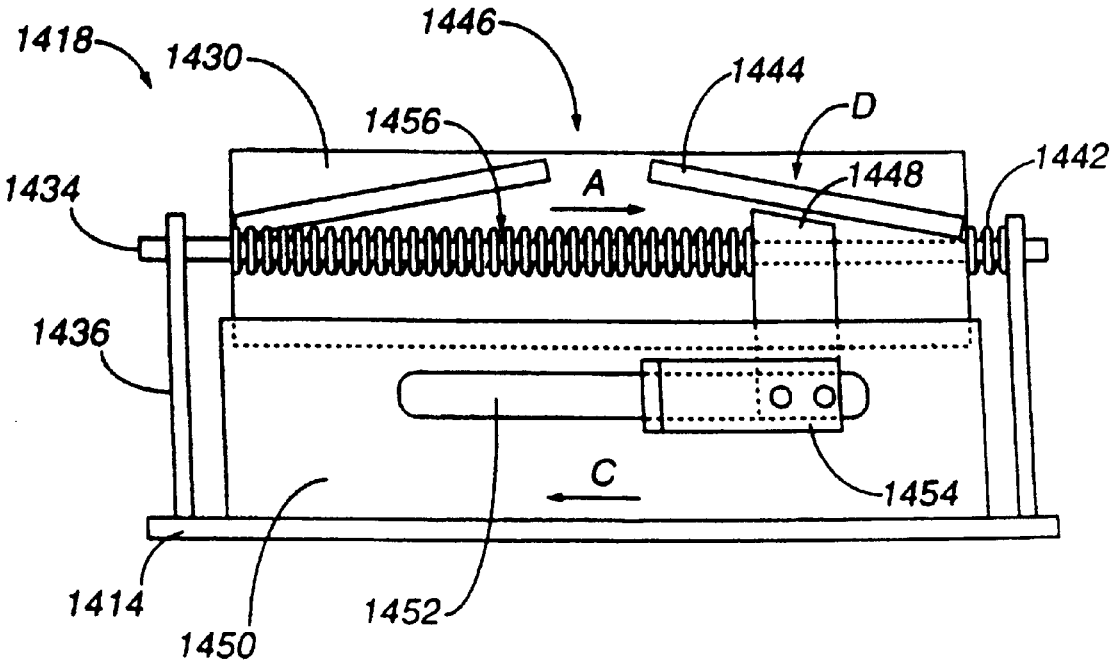
FIG. 23*b* is a rear elevational view taken along line 23—23 of FIG. 22 showing the outer binding element of the binding assembly in a locked position.

As best shown in FIGS. 23*a* and 23*b*, the recessed member 1430 includes at least one, and preferably two, projections or inclined members 1444 on the rear side thereof. The inclined members 1444 may be connected to or integrally formed with the recessed member 1430, and are spaced apart from one another to define an aperture 1446 therebetween. As discussed below, the aperture 1446 is sized to receive a locking member 1448 therein when the recessed member 1430 is in the "open" position.

The outer binding element 1418 also includes a support member 1450 defining a slot 1452 therein. The locking member 1448 is slidably connected to the shaft 1434, and an extension (not shown) of the locking member 1448 is captured within the slot 1452. A handle or lever 1454 is connected to the extension of the locking member 1448 and, as discussed below, is manipulated to move the locking member 1448 along the shaft 1434.

As best shown in FIGS. 23*a* and 23*b*, a first spring 1442 is disposed around the shaft 1434 and is connectively associated with the support structure 1436 and the recessed member 1430. The spring 1442 operates to bias the recessed member in the "open" position shown in FIGS. 22, 23*a*, 25*a* and 26 (i.e., such that the recessed member 1430 is operable to receive the outer binding tab 1424 on the boot 1412).

As shown in FIG. 23*b*, a second spring 1456 is disposed around the shaft 1434 and is connectively associated with the recessed member 1430 and the locking member 1448. The second spring 1456 operates to bias the locking member 1448 in the "locked" position. In turn, as discussed below, when in the locked position, the locking member 1448 resists the biasing force of the first spring 1442 to maintain the recessed member 1430 in the locked position.

As best shown in FIG. 23*a*, when the recessed member 1430 is in the open position, the locking member 1448 is positioned within the aperture 1446 and the inclined member 1444 engages the locking member 1448 to thereby resist the biasing force of the second spring 1456 (which biases the locking member in the direction of Arrow A).

As discussed in more detail below, when the recessed member 1430 is rotated against the force of the first spring 1442 (i.e., in the direction of Arrow B shown in FIGS. 23*a,* 25*b* and 25*c*) the inclined member 1444 moves out of contact with the locking member 1448. Consequently, the locking member 1448 is biased by the second spring 1456 to move (in the direction of Arrow A) underneath the inclined member 1444 to the "locked" position, as shown in FIG. 23*b.*

The locking member 1448 resists the biasing force of the first spring 1442 (which is in the direction of Arrow D in FIG. 23*b*), and thereby maintains the recessed member 1430 in the locked position, by engaging the inclined member 1444 and thereby preventing the recessed member 1430 from rotating into the position shown in FIG. 23*a.*

To "unlock" the recessed member 1430, as discussed below, the lever 1454 is manipulated by a snowboarder against the biasing force of the second spring 1456 (i.e., in the direction of Arrow C in FIG. 23*b*). As shown in FIG. 23*b,* the locking member 1448 must be moved along the slot 1452 until it clears the inclined member 1444. At that point, the recessed member 1430 moves back into the fully open position and the locking member 1448 is captured within the aperture 1446, as shown in FIG. 23*a.*

Figure 24A:
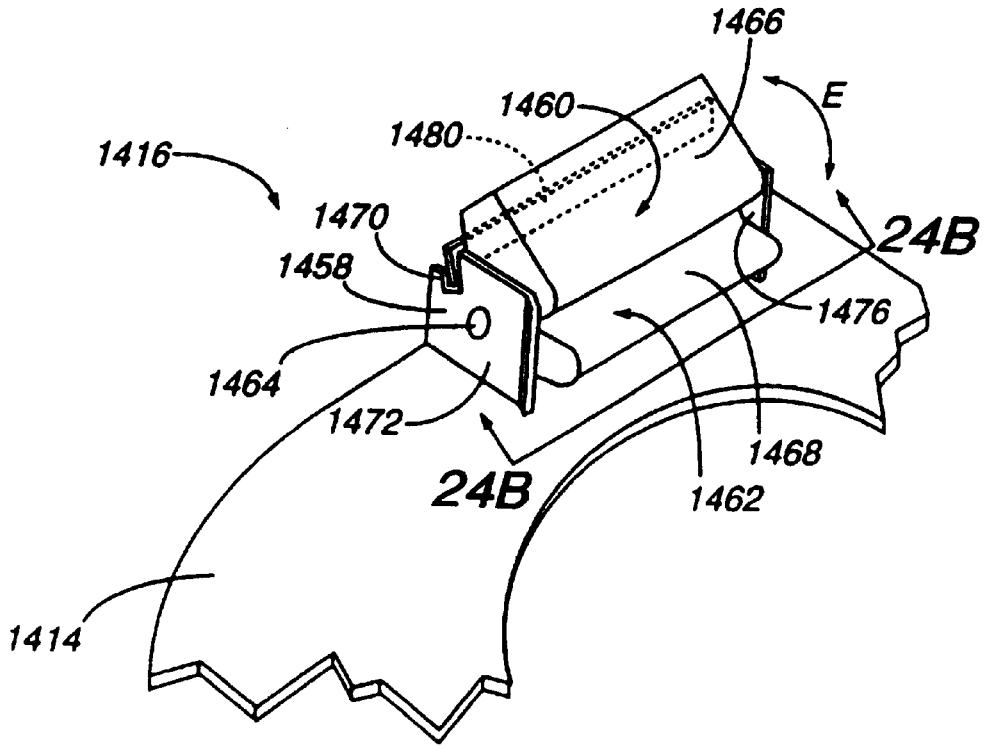
FIG. 24*a* is a front perspective view of the inner binding element of the binding assembly taken along line 24*a*—24*a* of FIG. 22.
Figure 24B:
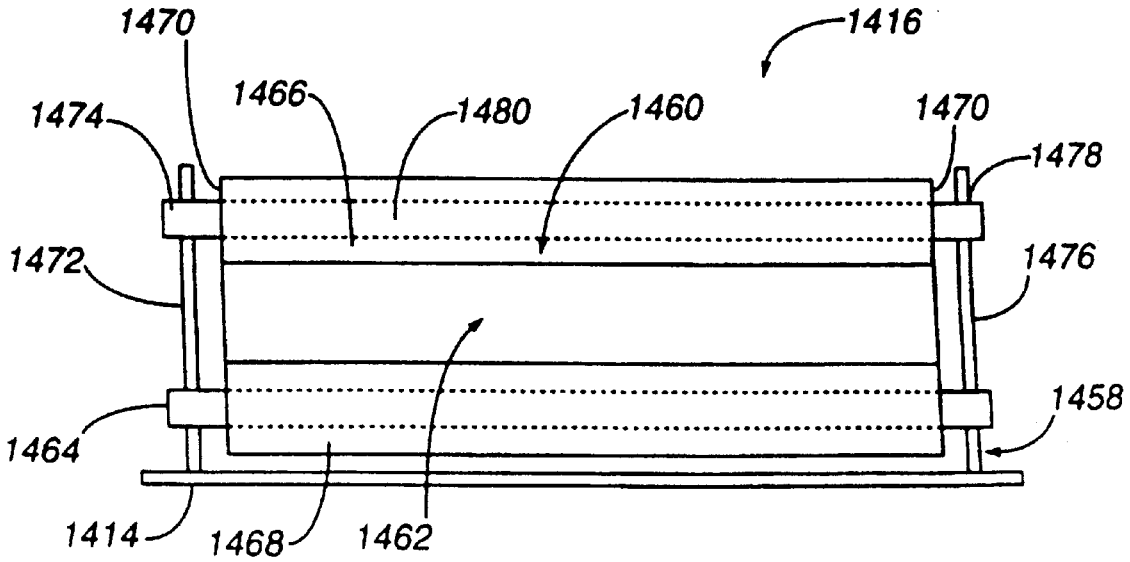
FIG. 24*b* is a front elevational view of the inner binding element taken along line 24*b*—24*b* of FIG. 24*a*.
Figure 24C:
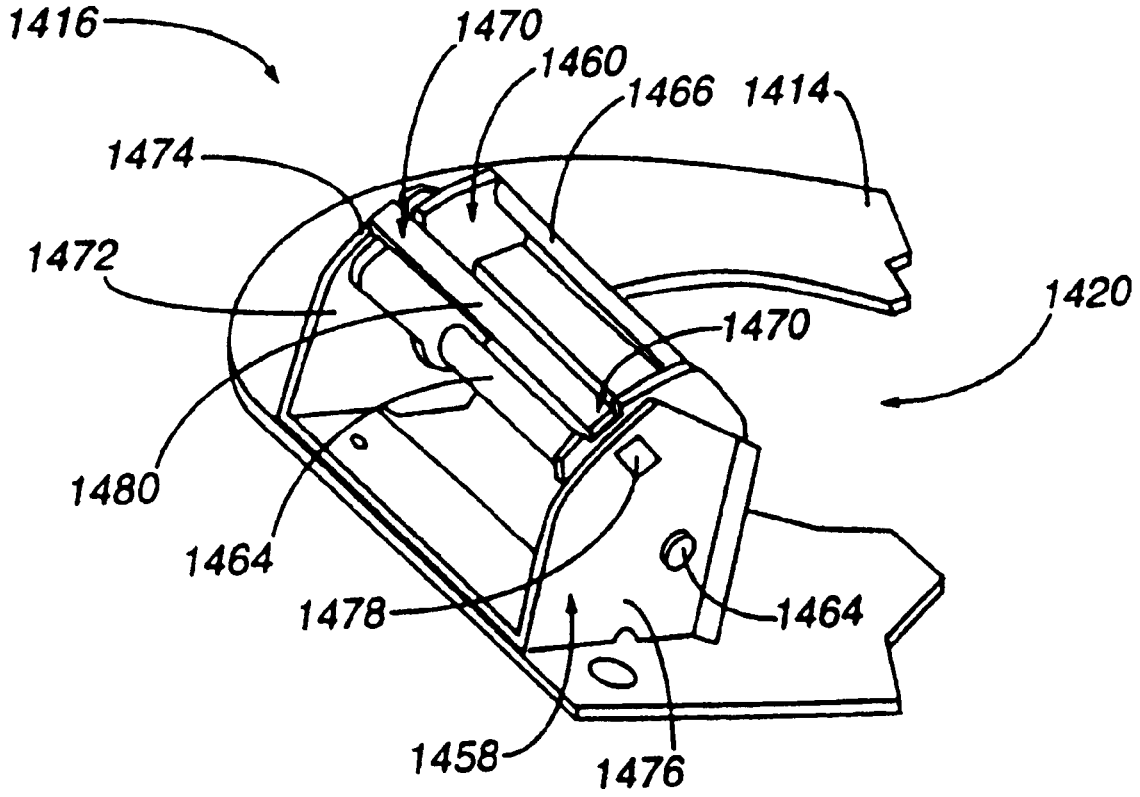
FIG. 24*c* is a rear perspective view of the inner binding element taken along line 24*c*—24*c* of FIG. 22.

The preferred embodiment of the inner binding element 1416, as best shown in FIGS. 24*a*–24*c,* includes a base 1458 secured to or integrally formed with the binding plate 1414. A binding member 1460 defining a recess 1462 therein is rotatably connected to the base 1458 by means of a shaft 1464. The recess 1462 is defined by an upper flange member 1466 and a lower flange member 1468.

As best shown in FIG. 24*c,* the binding member 1460 preferably defines a slot 1470 in the rear side thereof. In addition, a first end 1472 of the base 1458 preferably defines a cooperating slot 1474 therein, and a second end 1476 of the base 1458 defines an aperture 1478 therein. The slots 1470 in the binding member 1460, and the slot 1474 and the aperture 1478 in the base 1458, are sized to receive a removable locking bar 1480 therein.

As shown in FIG. 24*c,* the locking bar 1480 may be disposed in the aperture 1478 and the respective slots 1470, 1474 to substantially lock the binding member 1460 in place. However, as discussed below, the locking bar 1480 may be readily removed from the inner binding element 1416 by any suitable means, including a pull wire or other release mechanism (not shown), to allow the binding member 1460 to rotate (i.e., in the directions along Arrow E in FIG. 24*a*) on the shaft 1464.

Figure 25A:
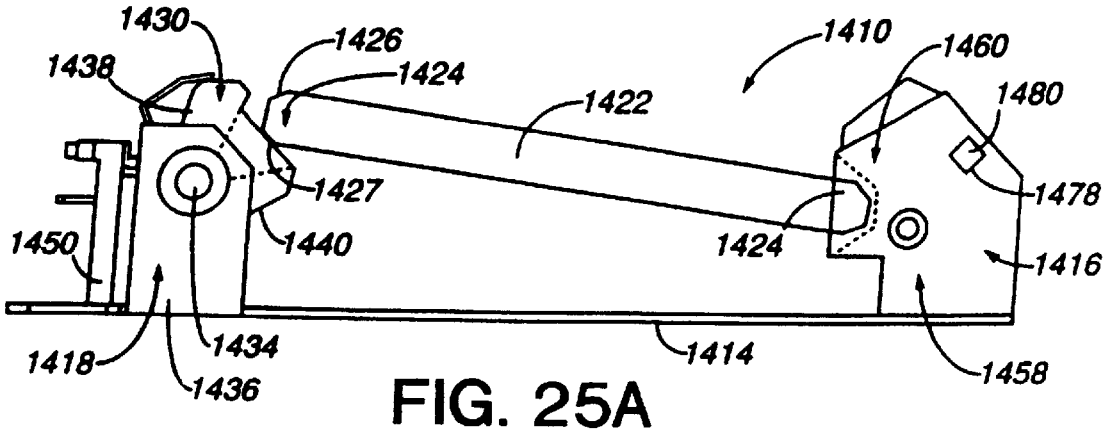
FIGS. 25*a*–25*c* are various operational views of the fourth preferred embodiment of the present invention showing the binding tabs of the boot plate engaging the binding elements of the binding assembly.
Figure 25B:
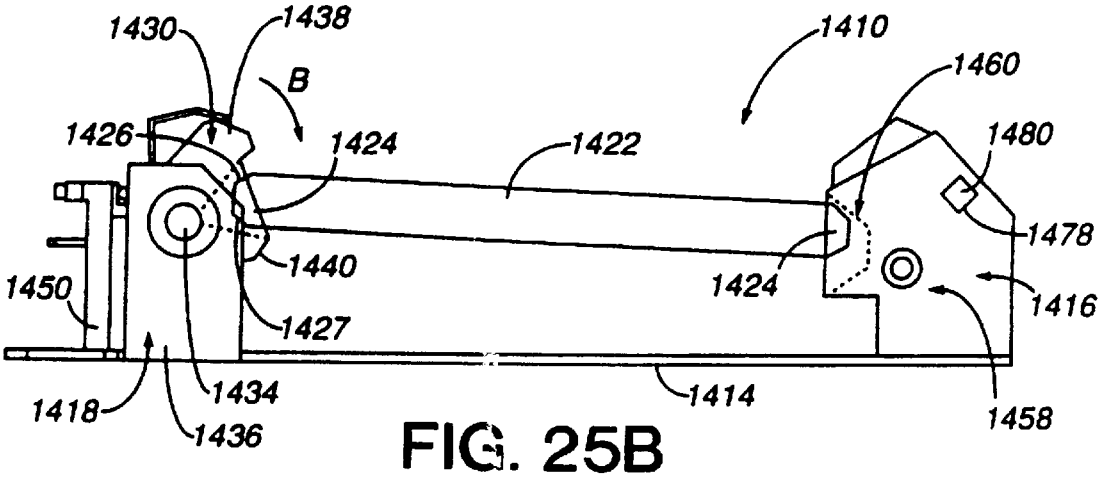
Figure 25C:
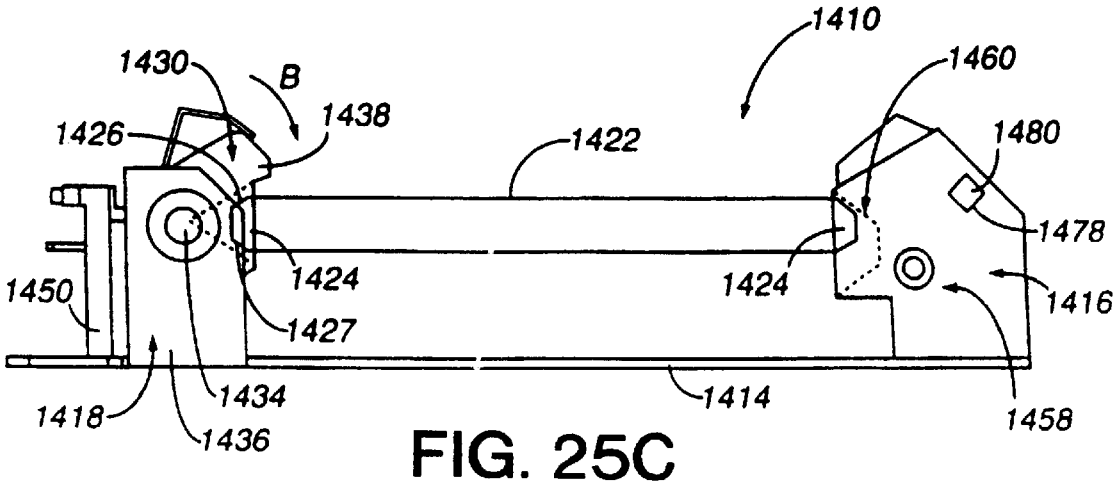

The operation of the fourth preferred embodiment of the binding assembly 1410 is illustrated in FIGS. 25*a*–25*c.* As shown in FIG. 25*a,* the boot plate 1422 (and thus the boot 1412) addresses the binding plate 1414 at an angle wherein the inner side of the boot 1412 is tilted toward the ground. The inner binding tab 1424 is first inserted into the recess 1462 defined by the binding member 1460 of the inner binding element 1416, which is preferably locked by the locking bar 1480.

After the inner binding tab 1424 is positioned in the inner binding element 1416, the outer binding tab 1424 is lowered until the bottom edge 1427 thereof engages the lower flange 1440 of the outer binding element 1418. As shown in FIG. 25*b,* the weight of the snowboarder is utilized to cause the recessed member 1430 of the outer binding element 1418 to rotate (i.e., in the direction of Arrow B). As the recessed member 1430 rotates, the upper flange 1438 rotates into position over the top edge 1426 of the outer binding tab 1424 to thereby capture the outer binding tab 1424 within the recess 1432. When the recessed member 1430 rotates to substantially the position shown in FIG. 24*c,* the binding tabs 1424 are fully captured within the respective inner and outer binding elements 1416, 1418, and the boot 1412 is thereby secured to the snowboard.

As can be ascertained from the previous discussion of FIGS. 23*a* and 23*b,* when the boot plate 1422 first engages the outer binding element 1418 (see FIG. 25*a*), the first spring 1442 is biasing the recessed member 1430 of the outer binding element 1418 in the "open" position shown in FIGS. 23*a* and 25*a.* In the "open" position, the locking member 1448 of the outer binding element 1418 is disposed within the aperture 1446 and is engaged by the inclined member 1444.

As discussed above, the snowboarder's weight is used to overcome the biasing force of the first spring 1442 to rotate the recessed member 1430 to the "closed" or "locked" position. As the recessed member 1430 rotates to the position shown in FIG. 25*c,* the inclined member 1444 rotates out of engagement with, or "clears," the locking member 1448. Consequently, the locking member 1448 is biased by the second spring 1456 into the "locked" position best shown in FIG. 23*b.* In this position, the locking member 1448 engages the bottom edge of the inclined member 1444 to resist the biasing force of the first spring 1442, which biases the recessed member 1430 to the "open" position (i.e., in the direction of Arrow D in FIG. 23*b*).

In addition, the snowboarder's weight on the outer binding element 1418 counteracts the biasing force of the first spring 1442 to maintain the recessed member in the "closed" position. However, when the snowboarder becomes airborne (e.g., during a jump or a turn), his or her weight is consequently not distributed along the recessed member 1430. During these instances, the locking member 1448 alone maintains the recessed member 1430 in the "closed" or "locked" position.

The boot 1412 may be removed from the binding assembly 1410 in two ways—either or both of which may be used. In the preferred embodiment, the snowboarder manipulates the lever 1454 on the outer binding element 1418 to thereby slide the locking member 1444 (against the biasing force of the second spring 1456) out of engagement with the inclined member 1444 and into the aperture, at which point the recessed member 1430 is biased by the first spring 1442 into the "open" position and the boot 1412 may be removed.

As an alternative, as discussed above with respect to FIGS. 24*a*–24*c,* the locking bar 1480 of the inner binding element 1416 may be removed from the binding member 1460 and the base 1458 to "unlock" the binding member 1460. After the locking bar 1480 is removed, the binding member 1460 is free to rotate on the shaft 1464 to an "open" position where the boot 1412 may be removed therefrom.

Moreover, if desired or needed, both of the inner and outer binding elements 1416, 1418 may be manipulated as discussed above to unlock the binding assembly 1410 and allow the snowboarder to remove the boot 1412 therefrom.

Figure 28:
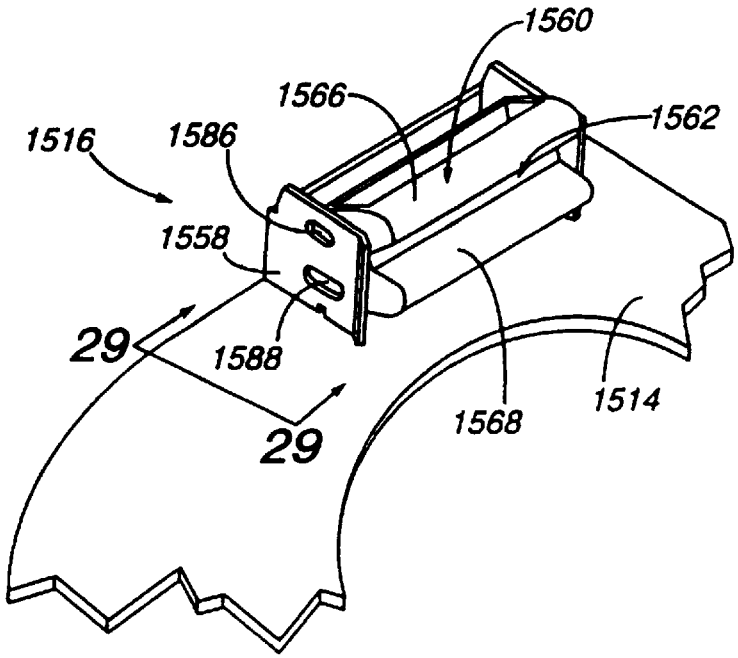
FIG. 28 is a front perspective view of an alternate embodiment of the inner binding element for the fourth preferred embodiment of the boot and binding assembly of the present invention.
Figure 29A:
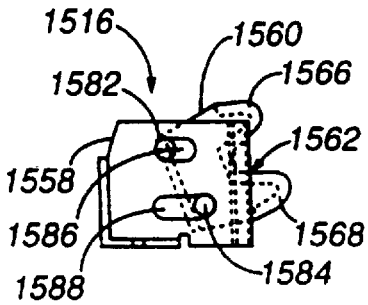
FIG. 29*a* is a side view taken along line 29—29 of FIG. 28 showing the inner binding element in an open position.
Figure 29B:
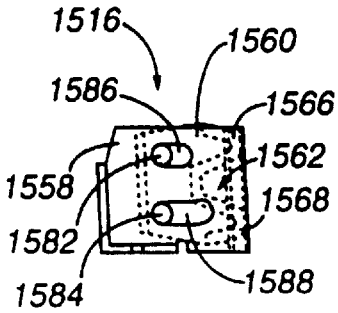
FIG. 29*b* is a side view taken along line 29—29 of FIG. 28 showing the inner binding element in a closed position.
Figure 30:
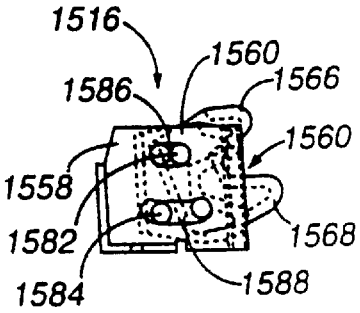
FIG. 30 is a side view of the inner binding element of FIG. 28 showing the open and closed positions thereof in phantom lines.

An alternate embodiment of the inner binding element 1516 is illustrated in FIGS. 28–30. As shown therein, the inner binding element 1516 includes a base 1558 secured to or integrally formed with the binding plate 1514. A binding member 1560 defining a recess 1562 therein is rotatably and slidably connected to the base 1558 by means of two shafts 1582, 1584 carried within respective slots 1586, 1588 defined in the base 1558. The recess 1562 is defined by an upper flange member 1566 and a lower flange member 1568.

As best shown in FIG. 29*a,* the binding member 1560 is normally biased in an "open" position by any suitable means, including a coil or clip spring (not shown). In this position, the inner binding element 1516 is ready to accept the inner binding tab 1524 of the boot 1512.

Similar to the operation discussed above with respect to FIGS. 25*a*–25*c,* to secure the boot 1512 to the snowboard the inner binding tab 1524 is inserted into the recess 1562 defined by the binding member 1560. However, unlike the inner binding element 1516 discussed above with respect to FIGS. 22–27, the binding member 1560 of the inner binding element 1516 rotates and slides along the slots 1586, 1588 defined in the base to accept and capture the inner binding tab 1524.

As the inner binding tab 1524 is inserted into the recess 1562, the inner binding tab 1524 overcomes the biasing force of the spring and the binding member 1560 is consequently forced to move along the slots 1586, 1588 until the binding member 1560 reaches the fully closed position shown in FIG. 29*b.* As can be appreciated, because the bottom slot 1588 is inclined along a portion of its length and is longer than the top slot 1586, the binding member 1560 is thereby translated and rotated as it moves from the position shown in FIG. 29*a* to the position shown in FIG. 29*b.* The translational and rotational movement of the binding member 1560 is best shown in FIG. 30, wherein the positions of FIGS. 29*a* and 29*b* are shown in phantom lines.

To remove the boot 1512 from the binding assembly 1510, the preferred method discussed above with respect to FIGS. 25*a*–25*c* is used. After the outer binding tab 1524 of the boot 1512 is released from the outer binding element 1518, the inner binding tab 1524 is simply removed from the inner binding element 1516, and the binding member 1560 is biased by the spring means to return to the open position shown in FIGS. 28 and 29*a*.

As can be seen, the inner binding element 1516 depicted in FIGS. 28–30 does not include a locking means to maintain the binding member 1560 in any one position. Rather, the inner binding element 1516 is spring-biased and rotates and translates to receive and capture the inner binding tab 1524 of the boot 1512 therein.

A fifth preferred embodiment of the boot and binding assembly 1610 of the present invention is shown in FIGS. 31–48. The binding assembly 1610 includes a boot (not shown) and a binding plate 1614 (1714). In use, the binding plate 1614 (1714) is mounted on the top surface of a snowboard (not shown).

As described below in greater detail, the binding plate 1614 (1714) includes a pair of binding elements 1616, 1618 (1718) connected thereto. The binding elements 1616, 1618 (1718) may be connected to the binding plate 1614 (1714) by any suitable means, including rivets, screws and weldments. In addition, the binding elements 1616, 1618 (1718) may be adjustably mounted to the binding plate 1614 (1714) to accommodate boots (and therefore feet) of varying width.

Figure 31:
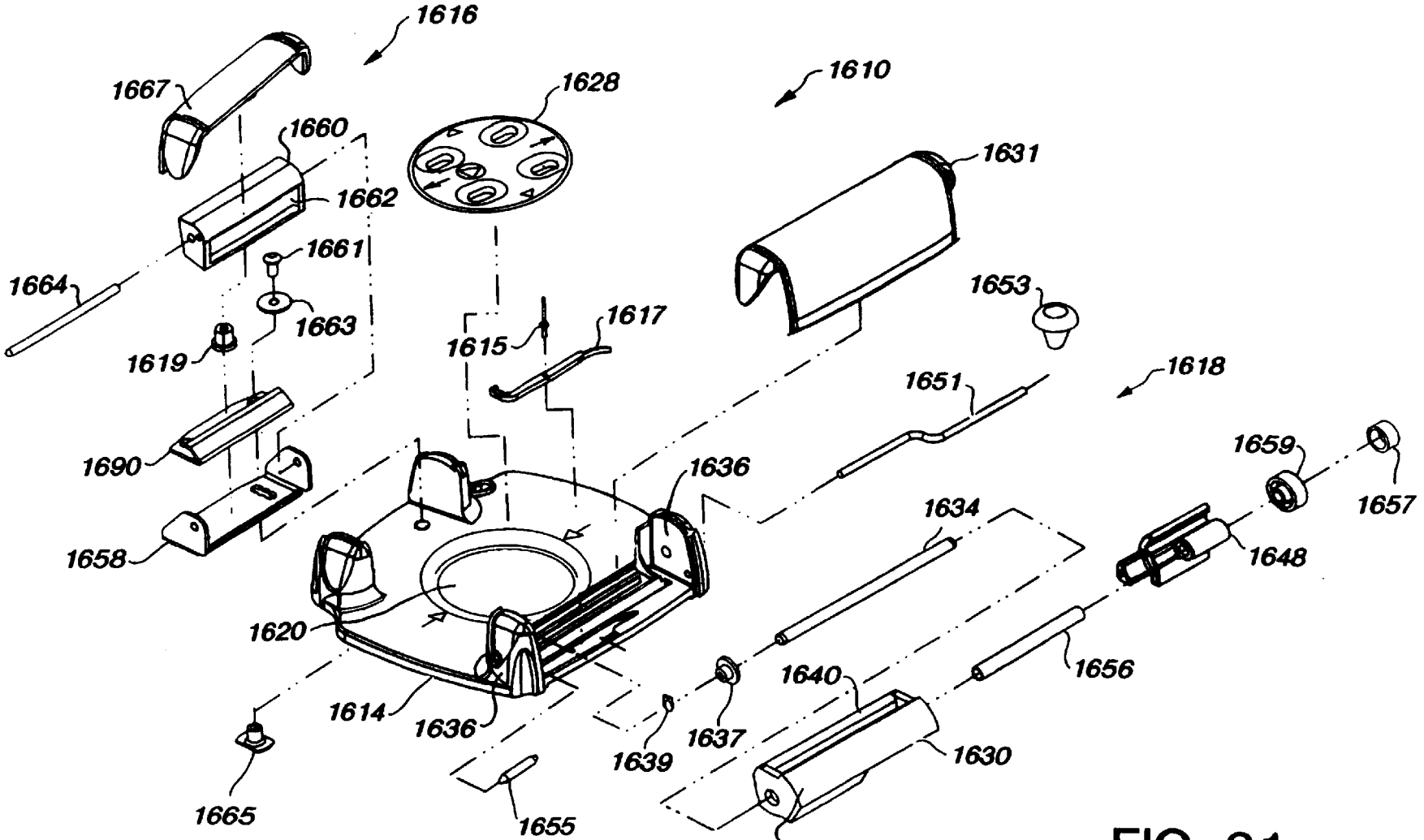
FIG. 31 is an exploded perspective view of a fifth preferred embodiment of the boot and binding assembly of the present invention.

As shown in FIG. 31, the binding plate 1614 (1714) also includes an opening 1620 for an adjusting disk 1628. As described above, the adjusting disk 1628 includes a number of slots therein to adjust the transverse and angular positions of the binding plate 1614 (1714) on the snowboard.

As shown and described above with respect to the first and fourth embodiments of the present invention, the boot includes a boot plate having a pair of opposing, horizontally-projecting binding tabs. Each of the binding tabs includes a top and a bottom edge, and is positioned to engage and mate with a respective binding element 1616, 1618 (1718) located on the binding plate 1614 (1714).

Like the first and fourth embodiments described above, the fifth embodiment of the present invention also provides a two-point or "bi" binding assembly (i.e., corresponding to the two binding elements 1616, 1618 (1718) on the binding plate 1614 (1714) or the two binding tabs on a boot plate) for mounting the boot (not shown) to a snowboard. The two binding tabs are positioned at approximately the mid-point of the boot (not shown) between the toe and the heel thereof.

Because the binding assembly 1610 has only two binding points, and therefore only two friction points to overcome, it is believed that the binding tabs will be easily engaged with the binding elements 1616, 1618 (1718). Further, as contrasted with the effort required to adjust four or more binding elements, it will be less difficult to adjust the position of only two binding elements 1616, 1618 (1718) to accommodate boots of different sizes.

In the fifth preferred embodiment of the binding assembly 1610 shown in FIGS. 31–48, the inner and outer binding elements 1616, 1618 (1718) rotate from open to closed positions to secure the boot (not shown) to the snowboard. The inner binding element 1616 cooperates with the outer binding element 1618 (1718) to secure the boot (not shown) to the snowboard.

A first embodiment of the outer binding element 1618 is shown in FIGS. 31–41. As shown therein, the outer binding element 1618 includes a recessed member 1630 adapted to receive and capture an outer binding tab on a boot (not shown). As shown in FIG. 31, the outer binding element 1618 may include a cover 1631 for protecting the recessed member 1630.

Like the outer binding element 1418 discussed above, the recessed member 1630 defines an upper flange 1638 and a lower flange 1640 at the extreme edges thereof. The flanges 1638, 1640 engage the top and bottom edges respectively, of the outer binding tab of the boot.

The recessed member 1630 is rotatably connected via a shaft 1634 to a support structure 1636, which may be connected to or integrally formed with a binding plate 1614. The shaft 1634 may be secured to the support structure 1636 by any suitable means, including a heal bushing 1637 and an E-clip 1639 or retaining rings.

Figure 32:
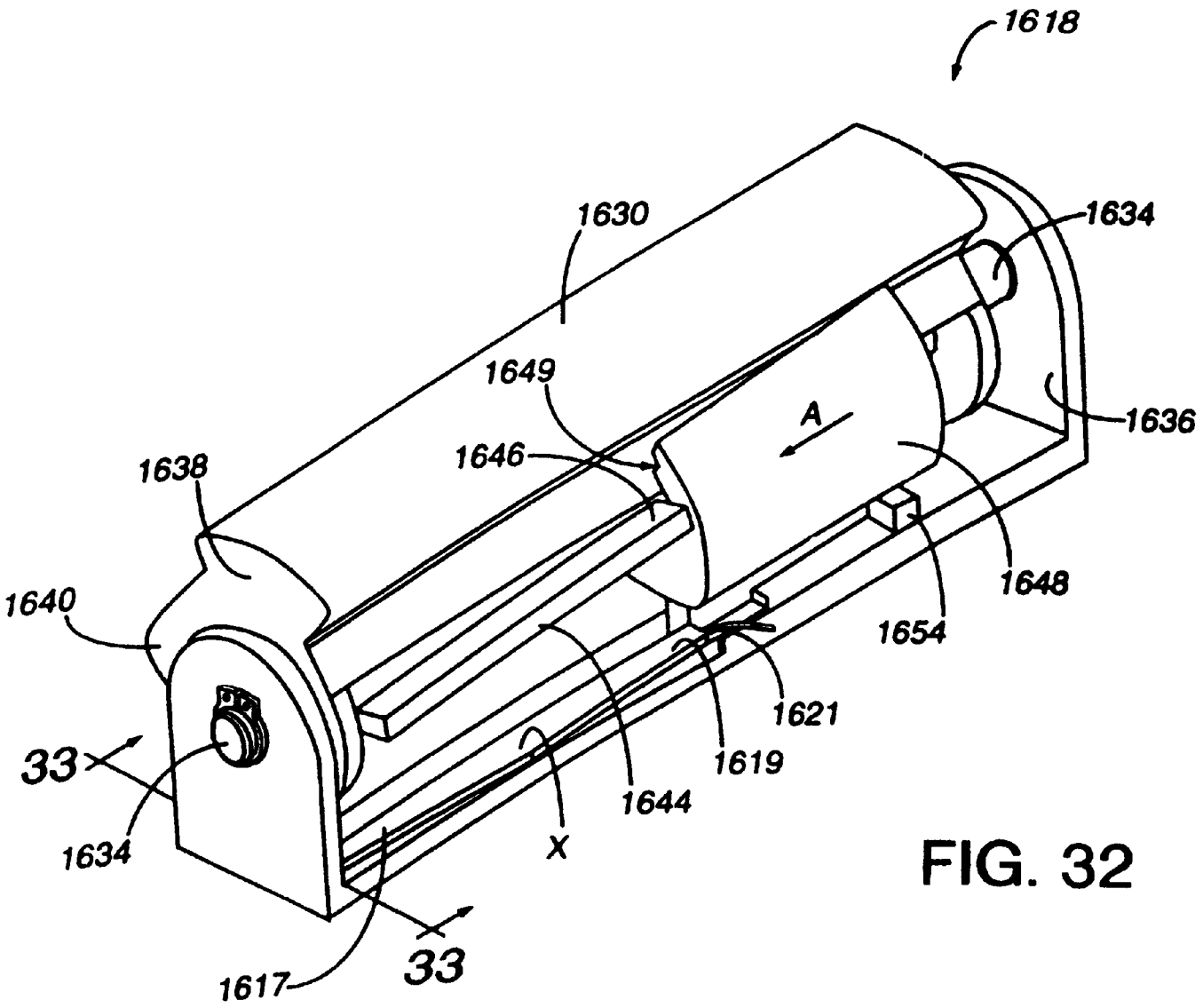
FIGS. 32–41 are consecutive operational views of the first embodiment of the outer binding element for the fifth preferred embodiment of the boot and binding assembly shown in FIG. 31.
Figure 40:
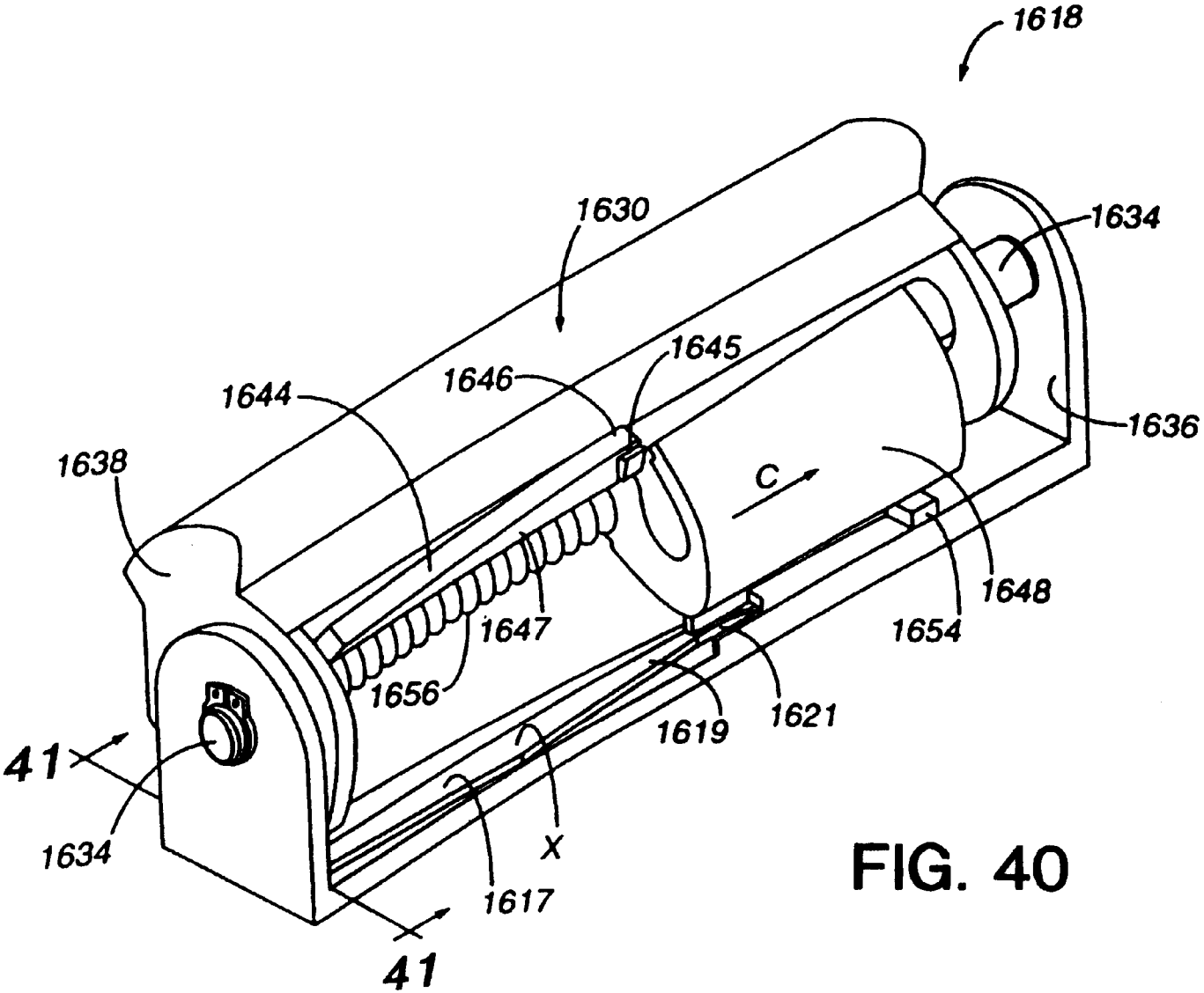

As shown in FIG. 32, the recessed member 1630 includes at least one projection or inclined member 1644 on the rear side thereof. The projection 1644 may be connected to or integrally formed with the recessed member 1630. As best shown in FIG. 40, the projection 1644 includes a slider block 1646 disposed on a lower side 1647 thereof. As discussed below, an end 1646 of the projection 1644 is sized to engage a cam or locking member 1648 when the recessed member 1630 is in the "open" position.

Figure 38:
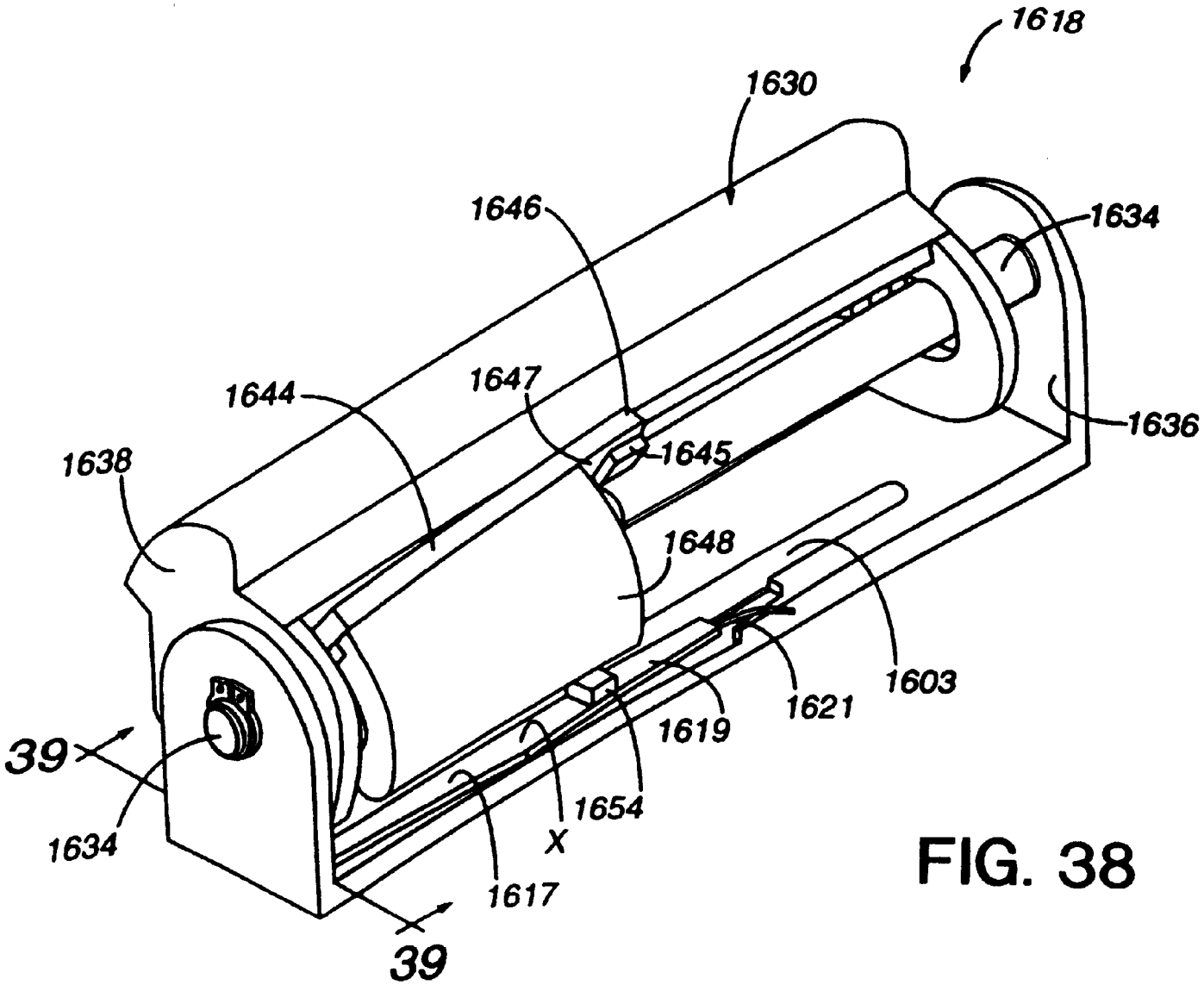

The locking member 1648 is slidably connected to the shaft 1634, and defines a groove 1649 therealong sized to receive the slider block 1645 on the projection 1644. In addition, as best shown in FIG. 38, an extension of the locking member 1648 rides within a slot 1603 formed in the support structure 1636.

As shown in FIG. 31, a knob 1653 is connected to a handle or lever 1654, which is connected to or integrally formed with the locking member 1648, via a pull cord 1651 and a cord return spring 1655. As discussed herein, the knob 1653 is pulled to move the locking member 1648 along the shaft 1634 from a locked to an unlocked position.

As best shown in FIG. 31, a first spring 1657 (including a spring bushing 1659) is disposed around the shaft 1634 and is connectively associated with the support structure 1636 and the recessed member 1630. The first spring 1657 operates to bias the recessed member 1630 in the "open" position (i.e., such that the recessed member 1630 is operable to receive the outer binding tab on the boot).

As best shown in FIGS. 31 and 40, a second spring 1656 is disposed around the shaft 1634 and is connectively associated with the recessed member 1630 and the locking member 1648. The second spring 1656 operates to bias the locking member 1648 in the "locked" position. In turn, as discussed above, when in the locked position, the locking member 1648 resists the biasing force of the first spring 1657 to maintain the recessed member 1630 in the locked position.

In addition, as shown in FIGS. 31–41, the outer binding element 1618 includes a spring latch or simplatch 1617 pivotally connected via a rivet 1615 at point X to the support structure 1636. A first end 1619 of the latch 1617 includes a spring tab 1621 integrally formed therewith, and a second end 1623 of the latch 1617 forms an upturned tab 1625.

As discussed in more detail below, the first end 1619 of the latch 1617 engages the locking member 1648 to allow the recessed member 1630 to rotate from a "closed" position to an "open" one, thereby allowing the boot to be removed from the binding assembly 1610. The second end 1623 of the latch 1617 is engaged by a biasing tab 1627 on the recessed member 1630 (see, for example, FIG. 33) to move the first end 1619 out of engagement with the locking member 1648.

The outer binding element 1618 shown in FIGS. 31–41 operates in much the same way as the outer binding element 1418 discussed above and shown in FIGS. 22–27. The operation of the outer binding element 1618 is described below.

Figure 33:
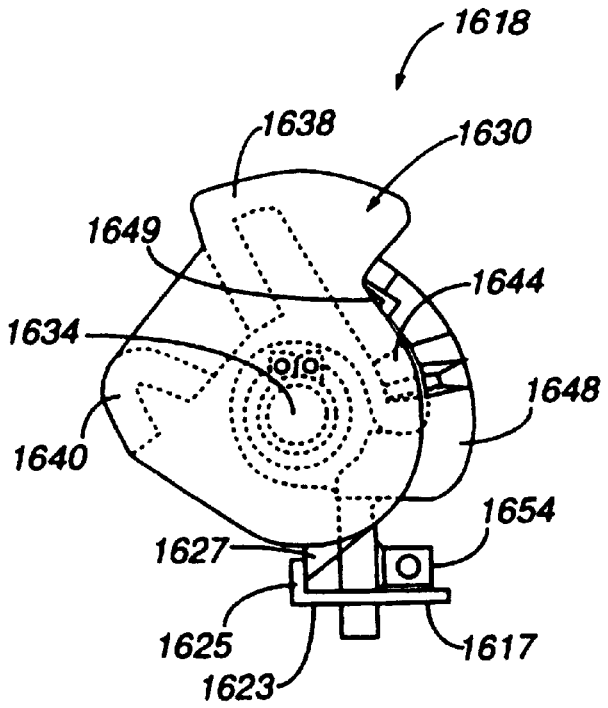

As best shown in FIGS. 32 and 33, when the recessed member 1630 is in the open position, the end 1646 of the projection 1644 engages the locking member 1648, thereby resisting the biasing force of the second spring 1656 (which biases the locking member 1648 in the direction of Arrow A). Further, as best shown in FIG. 33, the biasing tab 1627 on the recessed member 1630 engages the upturned tab 1625 on the latch 1617 to pivot the first end 1619 out of engagement with the locking member 1648, thereby allowing the locking member 1648 to slide forward (in the direction of Arrow A) once the projection 1644 clears the locking member 1648.

Figure 35:
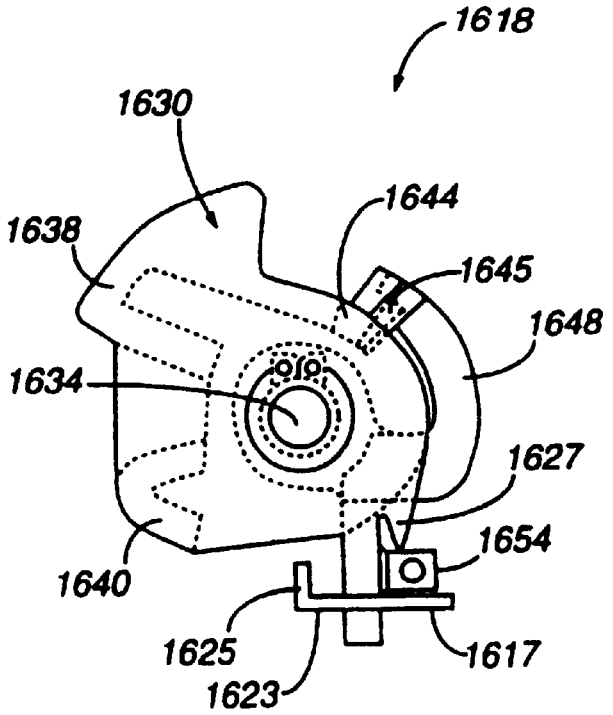
Figure 34:
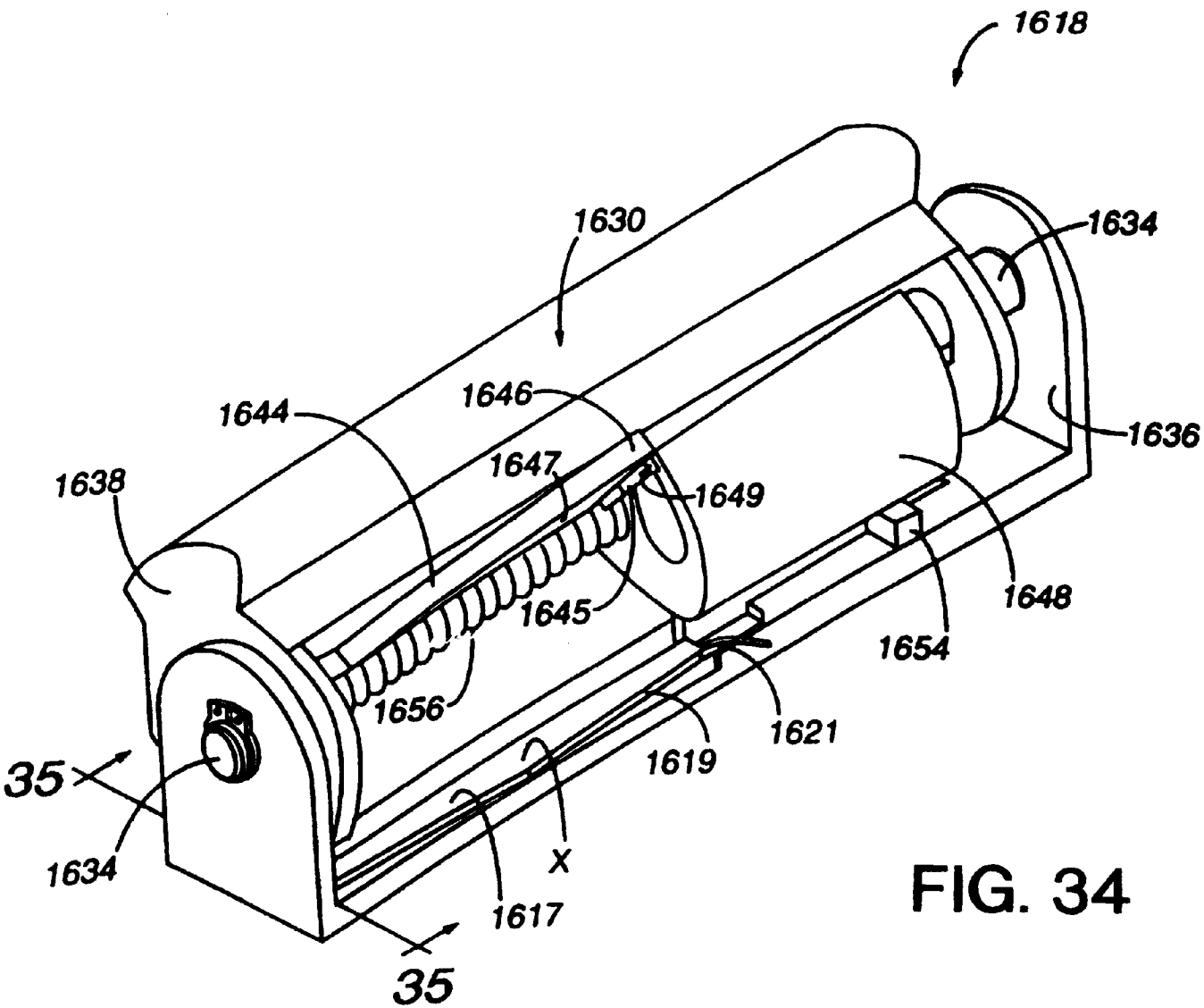

As shown in FIGS. 34 and 35, as the boot tab is positioned within the recessed member 1630, the recessed member 1630 is rotated to a point where the projection 1644 is ready to disengage the locking member 1648. In this orientation, the groove 1649 defined in the locking member 1648 is positioned to receive the slider block 1645 on the projection 1644. As best shown in FIG. 35, at this point the biasing tab 1627 on the recessed member 1630 still engages the upturned tab 1625 on the latch 1617, thereby pivoting the first end 1619 out of engagement with the locking member 1648.

Figure 36:
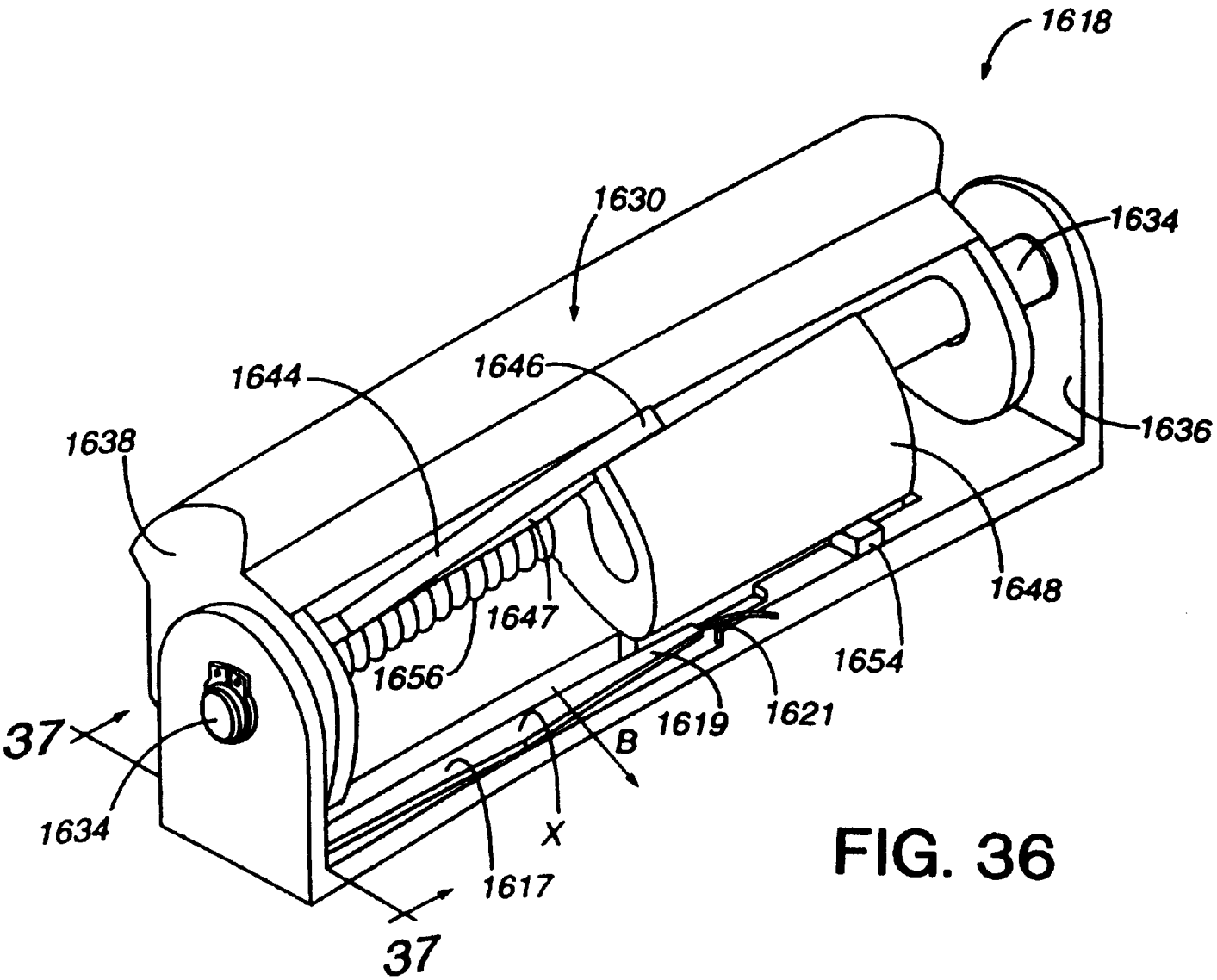
Figure 37:
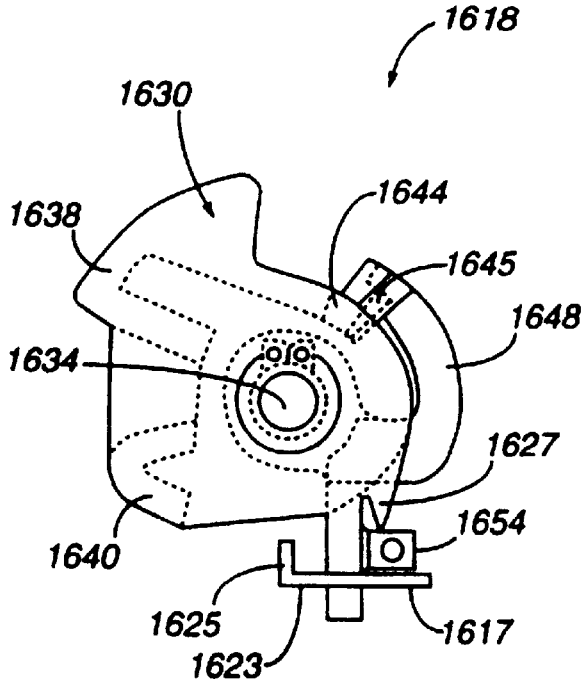

As shown in FIGS. 36 and 37, as the recessed member 1630 rotates to capture the boot tab therewithin, the projection 1644 disengages the locking member 1648, and the slider block 1645 is received within the groove 1649. Due to the biasing force of the second spring 1656, the locking member 1648 is urged to slide along and underneath the projection 1644 to thereby maintain the recessed member 1630 in a closed position. As best shown in FIG. 37, as the recessed member 1630 rotates to a closed position, the biasing tab 1627 disengages the upturned tab 1625 on the spring latch 1617, and the locking member 1648 rides against the spring latch (see FIG. 36) to counteract the biasing force of the spring tab 1621 and thereby pivot the first end 1619 in the direction of Arrow B.

Figure 39:
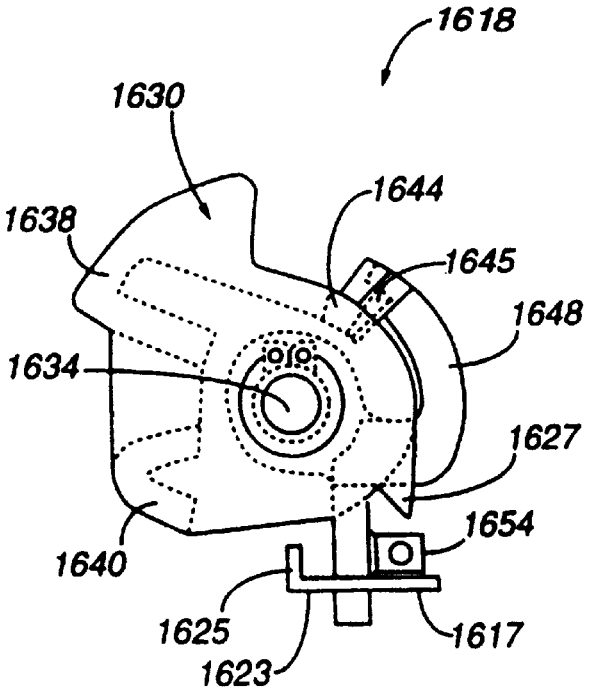

FIGS. 38 and 39 depict the outer binding element 1618 in the fully closed and locked position. As shown therein, the recessed member 1630 has rotated to the closed position to capture the boot tab therein. In addition, the locking member 1648 has moved to a position where its full length engages the lower side 1647 of the projection 1644 to lock the recessed member 1630 in place. Furthermore, as shown in FIG. 39, the biasing tab 1627 does not engage the upturned tab 1625 of the latch 1617 in the closed and locked position, and the locking member 1648 engages the latch 1617 to bias the latch 1617 in the position shown.

Figure 41:
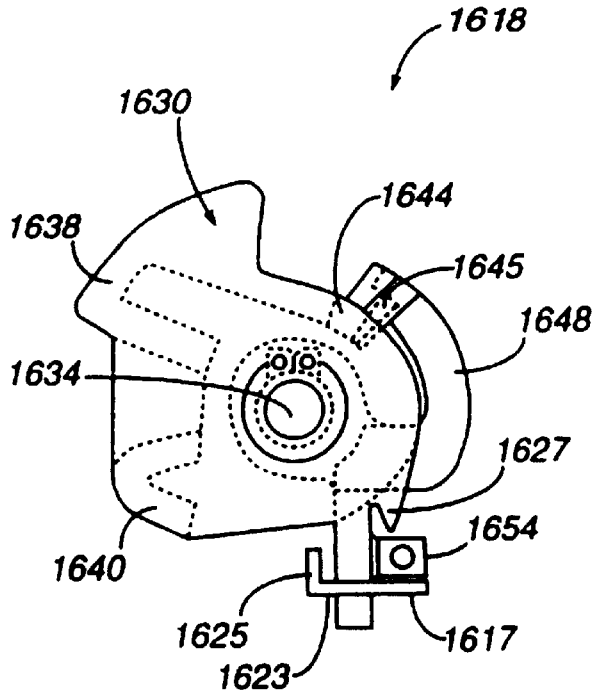

As shown in FIGS. 40 and 41, to unlock the outer binding element 1618 and thereby permit a snowboarder to remove the boot from the binding, the knob 1653 is manipulated to disengage the locking member 1648 from the projection 1644 (i.e., in the direction of Arrow C). Once the locking member 1648 clears the projection, the spring tab 1621 on the latch 1617 biases the first end 1619 to engage the locking member 1648, thereby locking the locking member in the open position shown in FIG. 40. Because the biasing tab 1627 does not engage the upturned tab 1625 on the latch 1617 when the locking member 1648 is initially disengaged from the projection 1644, as best shown in FIG. 41, the first end 1619 of the latch 1617 is allowed to engage the locking member 1648.

Subsequently, the recessed member 1630 is biased by the first spring 1657 to rotate to the fully open position shown in FIG. 32, and the boot may then be removed from the outer binding element 1618. Additionally, after the recessed member 1630 rotates to the open position, the biasing tab 1627 engages the upturned tab 1625 on the latch 1617 (see FIG. 33), thereby pivoting the latch 1617 out of engagement with the locking member 1648 and into the position shown in FIG. 32.

Figure 48:
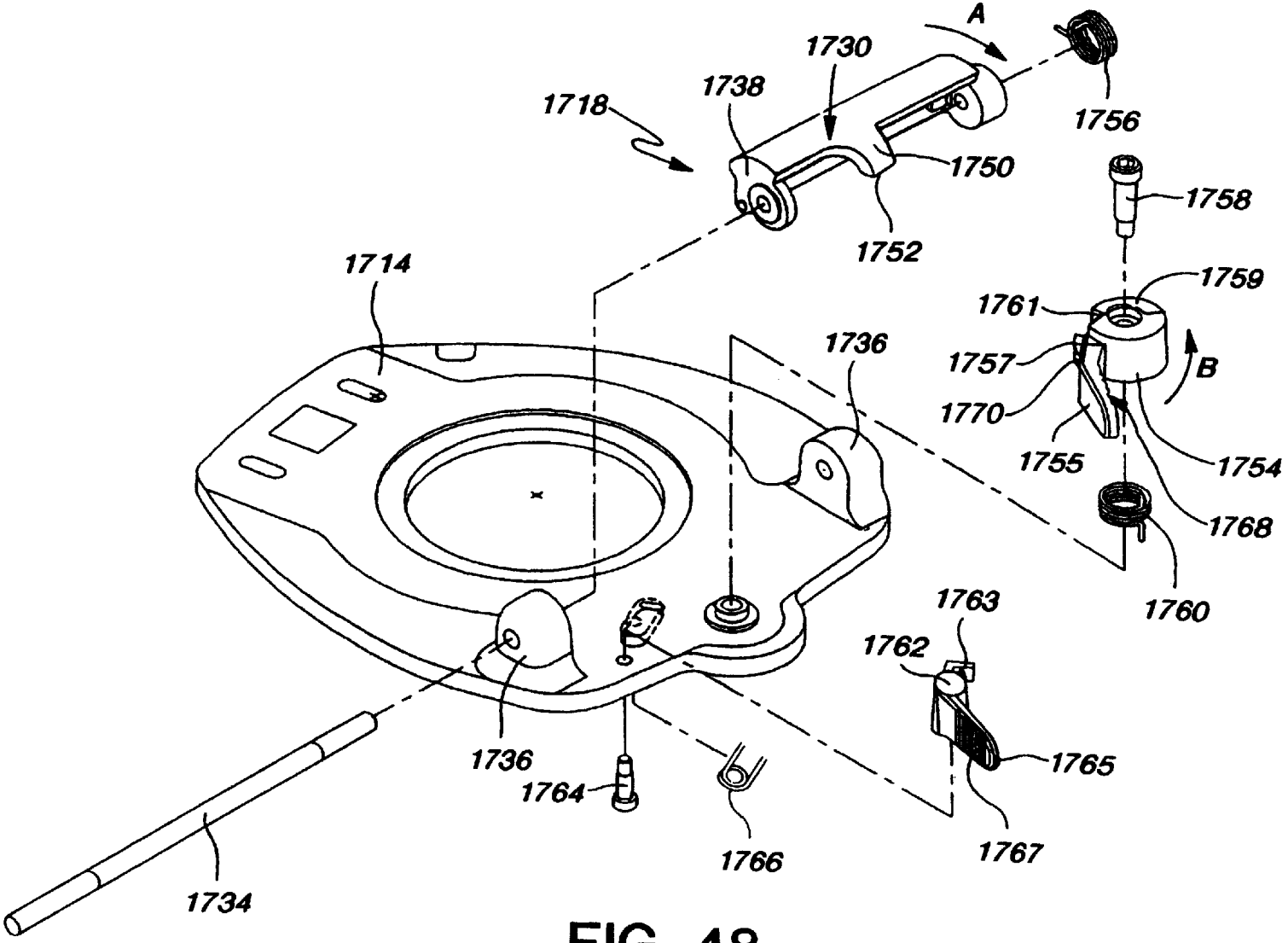
FIG. 48 is an exploded perspective view of a preferred embodiment of the outer binding element for the fifth preferred embodiment of the boot and binding assembly shown in FIG. 31.

The preferred embodiment of the outer binding element 1718 is shown in FIG. 48. As shown therein, the outer binding element 1718 includes a recessed member 1730 adapted to receive and capture an outer binding tab on a boot (not shown).

Like the outer binding element 1618 discussed above, the recessed member 1730 defines an upper flange 1738 and a lower flange (not shown) at the extreme edges thereof. The flanges engage the top and bottom edges respectively, of the outer binding tab of the boot.

The recessed member 1730 is rotatably connected via a shaft 1734 to a support structure 1736, which may be connected to or integrally formed with a binding plate 1714. The shaft 1734 may be secured to the support structure 1736 by any suitable means, including bushing and clip combinations or retaining rings.

As shown in FIG. 48, the recessed member 1730 includes a projection 1750 extending from the rear side thereof. The projection 1750 may be connected to or integrally formed with the recessed member 1730. As discussed below, an end 1752 of the projection 1750 is positioned to engage a cam barrel 1754 that is rotatably mounted on the binding plate 1714.

A first spring 1756 (which is preferably a torsional spring) is disposed around the shaft 1734 and is connectively associated with the support structure 1736 and the recessed member 1730. The first spring 1756 operates to bias the recessed member 1730 in the direction of Arrow A, which is the "open" position (i.e., such that the recessed member 1730 is operable to receive the outer binding tab on the boot).

The cam barrel 1754 is preferably rotatably connected to the binding plate 1714 by means of a shoulder bolt 1758 and a second spring 1760, which is preferably a torsional spring. The second spring 1760 is preferably connectively associated with the cam barrel 1754 and the binding plate 1714 to bias the cam barrel 1754 in the direction of Arrow B, which is the "closed" or "locked" position.

As shown in FIG. 48, the cam barrel 1754 includes a shoulder 1761 and an upwardly-inclined spiral-cut or spiralling ramp 1759 extending along at least a portion of the top circumference thereof. Further, the cam barrel 1754 includes a lever 1755 having a pawl-like projection 1757 extending from an outer side thereof. Preferably, the lever 1755 further includes a ridged surface 1768 on an inner side thereof for manipulation by the hands or fingers of a snowboarder.

In addition, the outer binding element 1718 includes a safety latch 1762, which is preferably rotatably connected to the binding plate 1714 by means of a shoulder screw 1764 and a third spring 1766, which is preferably a torsional spring. The third spring 1766 is preferably connectively associated with the safety latch 1762 and the binding plate 1714 to bias the safety latch 1762 in a "safety on" position.

Furthermore, the safety latch 1762 includes a lever 1765 and an arm or catch 1763 extending therefrom. The catch 1763 is operable to engage the projection 1757 on the cam barrel 1754 to hold the cam barrel 1754, and thus the recessed member 1730, in the "closed" position. The lever 1765 may be manipulated to release the catch 1763 from the projection 1757 to allow the cam barrel 1754 to be rotated from the "closed" or "locked" position, thereby allowing the recessed member 1730 to rotate from the "closed" to the "open" position. Preferably, the lever 1765 includes a ridged section 1767 for manipulation by the user's hands or fingers.

The operation of the preferred embodiment of the outer binding element 1718 is described directly below. As can be readily perceived from FIG. 48, when the recessed member 1730 is biased by the first spring 1756 in the direction of Arrow A in the "open" position, the projection 1750 engages the shoulder 1761 of the cam barrel 1754, thereby resisting the biasing force of the second spring 1760, which biases the cam barrel 1754 in the direction of Arrow B. At this position, the cam barrel 1754 is in the "unlocked" or "open" position and the safety latch 1762 is in the "safety off" position wherein the catch 1763 is resting against the outer side of the lever 1755.

When a boot tab (not shown) is positioned within the recessed member 1730 to secure a boot to a snowboard, the recessed member 1730 rotates to a point where the projection 1750 disengages the shoulder 1761 of the cam barrel 1754. At this time, the end 1752 of the projection 1750 is engaged by and rides along the upwardly-inclined spiral ramp 1759 defined in the cam barrel 1754. Due to the biasing force of the second spring 1760, the spiral ramp 1759 of the cam barrel 1754 is urged to slide underneath the end 1752 of the projection 1750, thereby maintaining the recessed member 1730 in the closed or locked position.

Furthermore, as the recessed member 1730 rotates to the closed position, the lever 1755 of the cam barrel 1754 rotates in relation to the safety latch 1762. As the lever 1755 moves, the catch 1763 slides along the cam surface 1770 of the projection 1757 disposed on the lever 1755. When the projection 1757 on the lever 1755 moves past the catch 1763, the biasing force of the third spring 1766 urges the catch 1763 of the safety latch 1762 to move past the projection 1757. In this position, the catch 1763 engages the projection 1757 to prevent the cam barrel 1754 from being inadvertently or accidentally rotated to an unlocked or open position.

To unlock the outer binding element 1718 and thereby permit a snowboarder to remove the boot from the binding, the lever 1765 of the safety latch 1762 and the lever 1755 of the cam barrel 1754 are manipulated by a user (i.e., moved or pinched together) to rotate the safety latch 1762 against the biasing force of the third spring 1766 to disengage or otherwise move the catch 1763 from the path of the pawl projection 1757, and to move the spiral ramp 1759 of the cam barrel against the biasing force of the second spring 1754 out of engagement with the projection 1750 on the recessed member 1730. After the safety latch 1762 is moved to the "safety off" position and the cam barrel 1754 is rotated to the unlocked or open position, the recessed member 1730 is free to rotate to the open position, at which point the boot may be removed from the outer binding element 1718.

As may be appreciated from the above disclosure, the upwardly-inclined spiral ramp 1759 provides the outer binding element 1718 with a self-tightening feature. For example, if snow and ice under the boot melts and/or the snowboarder's weight causes the recessed member 1730 to further rotate (i.e., in the opposite direction of Arrow A in FIG. 48), the inclined spiral ramp 1759 of the cam barrel 1754 will further slide underneath the projection 1750, thereby more tightly holding the recessed member 1730 in the closed position.

Further, in a preferred embodiment, the spiral ramp 1759 may include a hemispherical ridge that presents a normal surface for engagement by the projection 1750. By utilizing a hemispherical ridge, the close manufacturing tolerances required for a flat spiral ramp may be eliminated.

In addition, because the rear side of the recessed member 1730 is open, snow, ice and other debris may not accumulate therein.

Moreover, the diameter of the cam barrel 1754 and/or the angle of the inclined spiral ramp 1759 can be varied to vary the locking range of the recessed member 1730. Preferably, however, the diameter of the cam barrel 1754 may be within a range of 14 to 30 mm and the spiral angle may be approximately 8 degrees.

The preferred embodiment of the inner binding element 1616, as shown in FIGS. 31 and 42–47, includes a base 1658 secured to or integrally formed with the binding plate 1614. A binding member or clamp 1660 defining a recess 1662 therein is rotatably connected to the base 1658 by means of a shaft 1664. The recess 1662 is defined by an upper flange member 1666 and a lower flange member 1668. In addition, the inner binding element 1616 may include a cover 1667 for protecting the binding clamp 1660.

As best shown in FIGS. 42, 44, 45 and 47, the inner binding element 1616 also includes a spring element 1690 that is adjustably connected to the base 1658 by means of, for example, pan head screws 1661, washers 1663 and T-nuts 1665. Further, a compression spacer 1619 may be disposed between the spring 1690 and the binding clamp 1660. As will become apparent below, the spring 1690 is adjustable on the base 1658 to allow a snowboarder to adjust the biasing force of the spring 1690 on the binding member 1660.

As shown, the spring 1690 includes a base 1691 and an upstanding leaf element 1692 integrally and resiliently connected to the base 1691 at a narrowed section 1693. As described in more detail below, the leaf element 1692 includes a leading end 1694 that engages the binding member 1660.

Figure 42:
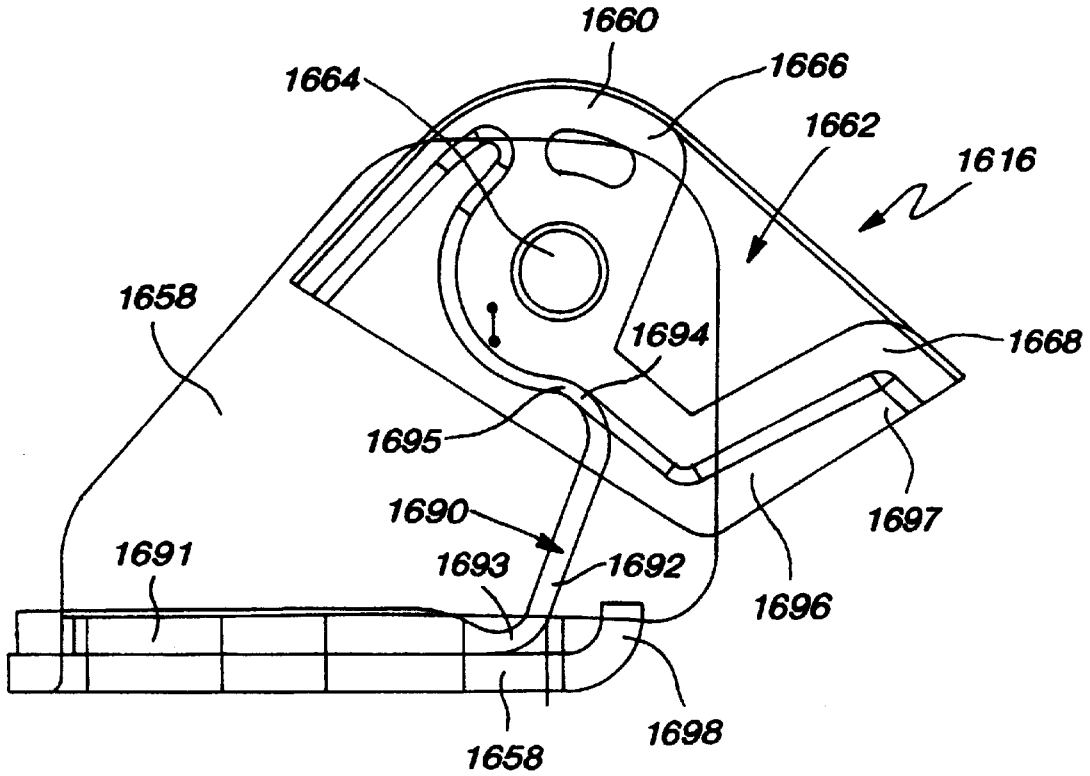
FIGS. 42–44 are operational views of the inner binding element for the fifth preferred embodiment of the boot and binding assembly shown in FIG. 31 in an open position.
Figure 43:
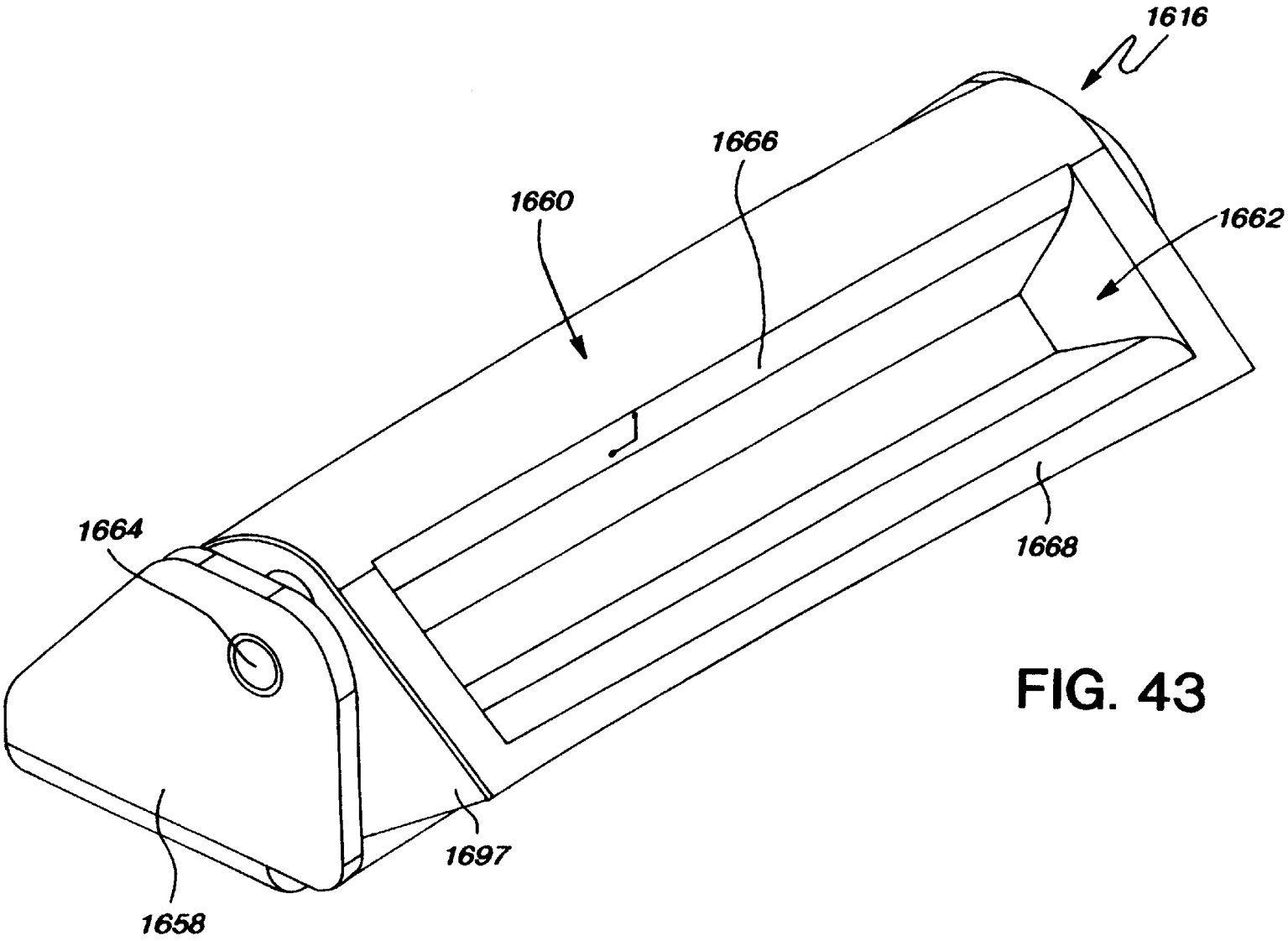
Figure 44:
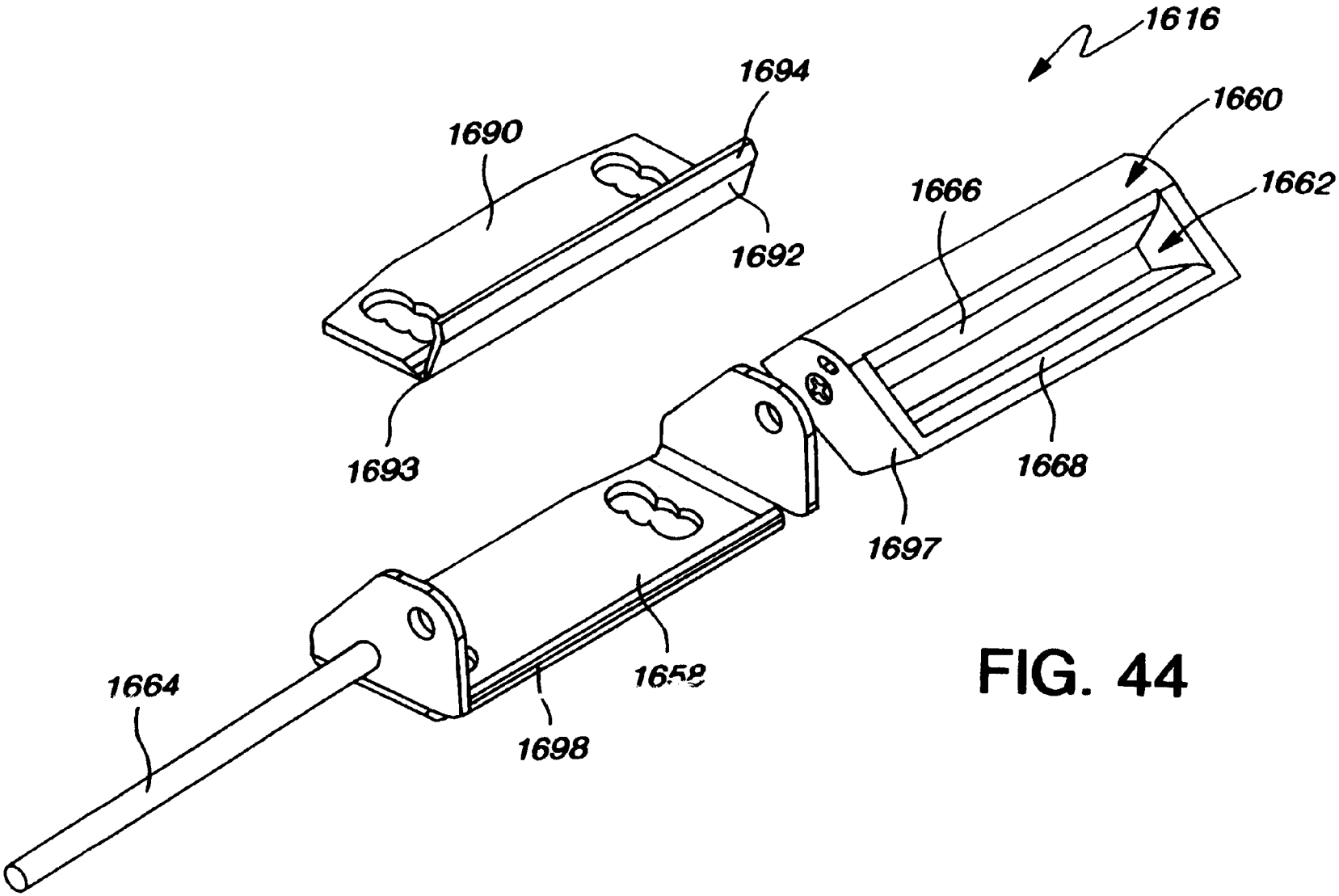

As best shown in FIG. 42, the leading end 1694 of the spring 1690 engages the rear side 1695 of the binding member 1660. By engaging the rear side 1695, the leading end 1694 of the spring 1690 operates to bias the binding member 1660 in an open position (i.e., where the binding member 1660 is positioned to receive a binding tab of a snowboard boot).

Figure 45:
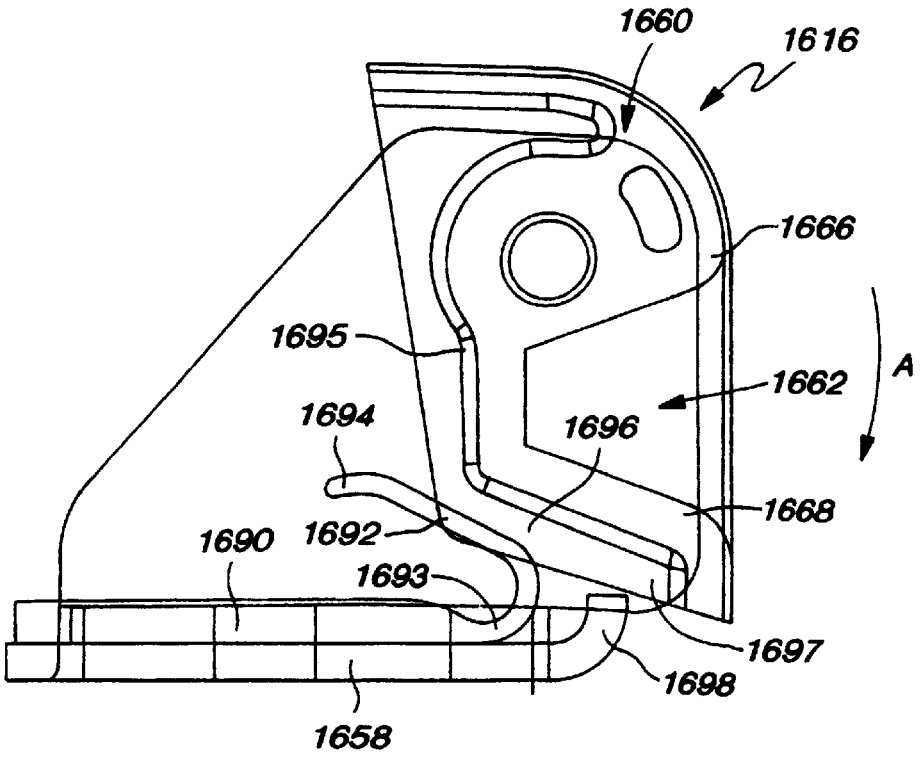
FIGS. 45–47 are operational views of the inner binding element for the fifth preferred embodiment of the boot and binding assembly shown in FIG. 31 in a closed position.
Figure 46:
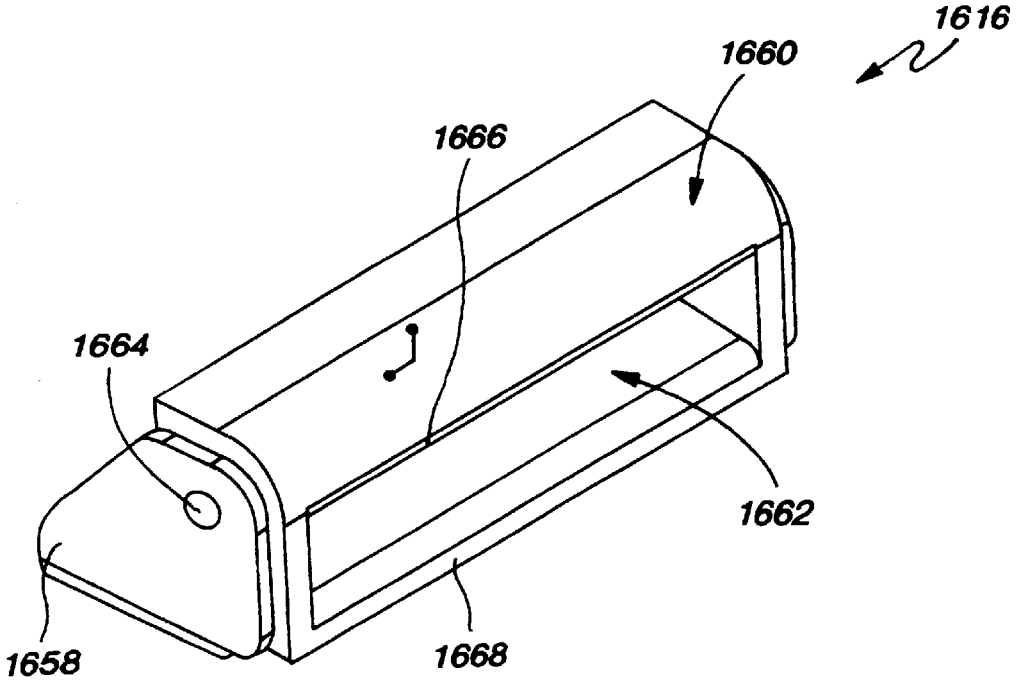
Figure 47:
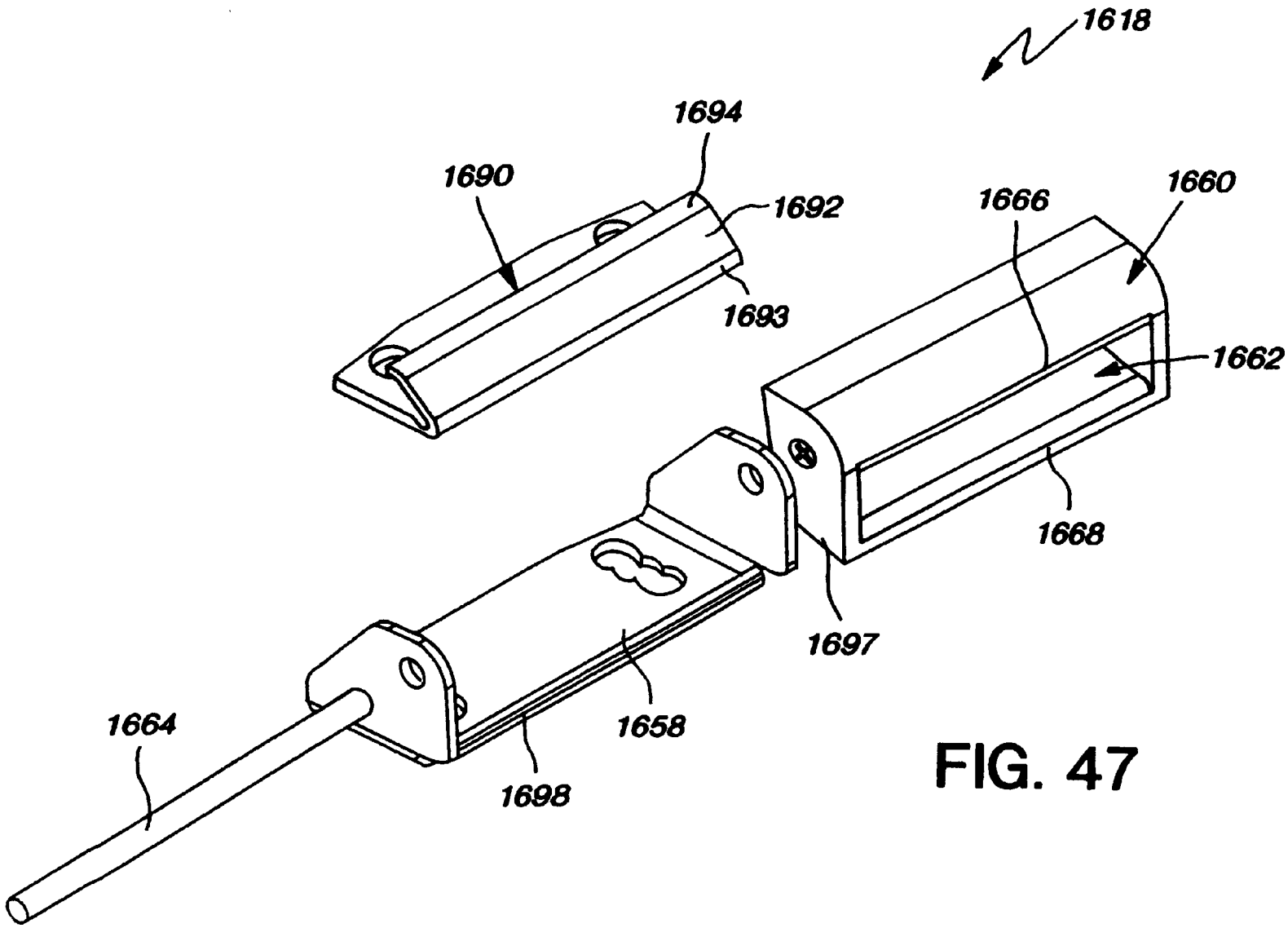

As best shown in FIGS. 42 and 45, the binding member 1660 further includes a cam member 1696. When the binding member 1660 is rotated by a binding tab of a snowboard boot (i.e., in the direction of Arrow A in FIG. 45) from an open position to a closed position, the cam member 1696 engages the leaf element 1692 and overcomes the biasing force of the spring 1690. Consequently, as best shown in FIG. 45, the binding member 1660 rotates against the biasing force of the spring 1690 until the lower edge 1697 thereof engages the upturned end 1698 of the base 1658. At the position shown in FIG. 45, the binding member 1660 is in the closed position.

When the binding tab of a snowboard boot is removed from the binding member 1660, the binding member 1660 is biased by the spring 1690 to rotate to the open position shown in FIG. 42.

The preferred operation of the fifth preferred embodiment of the binding assembly 1610 is described below and is similar to the operation of the fourth preferred embodiment of the present invention shown and described above.

When a snowboarder desires to secure a boot to a snowboard, she positions the boot at an angle wherein the inner side of the boot is tilted toward the ground. The inner binding tab is first inserted into the recess 1662 defined by the binding member 1660 of the inner binding element 1616. As the inner binding tab engages the lower flange member 1668 of the recess 1662 and the snowboarder depresses her boot towards the snowboard and the binding assembly 1610, the binding member 1660 overcomes the biasing force of the spring 1690 and rotates from the open position shown in FIG. 42 to the closed position shown in FIG. 45.

As the inner binding tab is positioned in the inner binding element 1616, the outer binding tab is lowered until the bottom edge thereof engages the lower flange 1640 of the outer binding element 1618. As the snowboarder depresses her boot, the recessed member 1630 rotates to capture the outer binding tab therewithin. When the recessed member 1630 rotates to substantially the position shown in FIGS. 38 and 39, the binding tabs are fully captured within the respective inner and outer binding elements 1616, 1618, 1718 and the boot is thereby secured to the snowboard.

In a preferred operation, the boot may be removed from the binding assembly 1610 by manipulating the safety latch 1762 and the cam barrel 1754 of the outer binding element 1718 to disengage the cam barrel 1754 from the projection 1750 of the recessed member 1730. After the spiral ramp 1759 of the cam barrel 1754 moves out of contact with the projection 1750, the recessed member 1730 rotates to a fully open position, at which point the outer binding tab may be removed from the outer binding element 1718 and the inner binding tab may be removed from the inner binding element 1616.

In an alternate operation, the boot may be removed from the binding assembly 1610 by manipulating the knob 1653 of the outer binding element 1618 to disengage the locking member 1648 from the projection 1644. Once the locking member 1648 clears the projection 1644, the spring tab 1621 on the latch 1617 biases the first end 1619 to engage the locking member 1648, thereby locking the locking member 1648 in the open position. Consequently, the outer binding tab is released from the outer binding element 1618 and the inner binding tab can then be removed from the inner binding element 1616.

An alternate operation of the fifth preferred embodiment of the present invention is described below and is similar to the operation of the first preferred embodiment shown and described above.

In the alternate operation, the inner and outer binding tabs of the boot are lowered in a substantially level plane to engage the respective inner and outer binding elements 1616, 1618. As the binding tabs engage the binding member 1660 and the recessed member 1630 of the respective inner and outer binding elements 1616, 1618, the binding and recessed members 1660, 1630 rotate to capture the binding tabs therewithin, and the recessed member 1630 is locked to securely retain the binding tabs within the respective inner and outer binding elements 1616, 1618.

As described above, to release the binding tabs from the binding assembly 1610, the knob 1653 is manipulated to unlock the outer binding element 1618. After the outer binding element is unlocked, the binding tabs are free to be removed from the inner and outer binding elements 1616, 1618.

In the fourth and fifth preferred embodiment shown in FIGS. 22–48, the recesses and recessed members 1430, 1460, 1560, 1630, 1730 of the respective binding elements 1416, 1418, 1516, 1616, 1618, 1718 are preferably shaped to define an involute curve and the binding tabs 1424, 1524 are preferably configured to define a pressure angle B (see FIG. 3*a*) in the range of about 20–25°.

As the recessed members 1430, 1460, 1560, 1630, 1730 are rotated, the involute curve presents a surface that is substantially normal to the top edge 1426, 1526, 1626 of the respective binding tab 1424, 1524. This feature operates to direct the forces imparted by the binding tabs 1424, 1524 on the binding elements 1416, 1418, 1516, 1616, 1618, 1718 in one direction, thereby practically eliminating the introduction of other force loads, such as shear loads.

In addition, it should be understood that the outer and inner binding elements 1418, 1416, 1516, 1616, 1618, 1718 of the present invention may be switched on the binding plate 1414, 1514, 1614, 1714. Thus, the inner binding elements 1416, 1516, 1616 may be used to bind the outer side of the boot 1412, 1512, and vice-versa.

It is contemplated that the below-listed components of the present invention may be formed of the following materials: the binding plate may be formed of a woven carbon fiber resin; the binding elements may be formed of metal, engineering plastic or aircraft aluminum; the cam barrel 1754 may be formed of steel; the shaft 1664 may be formed of 303-series stainless steel; the spring 1690 may be formed of nylon 6—6; the boot plate may be formed of nylon or polyurethane; the insert 1134 may be formed of polyurethane having a durometer of 60; the shell 1136 may be formed of polyurethane having a durometer of 52; the outsole 1142 may be formed of high-abrasion rubber; the highback 1280 may be formed of polyurethane 652; the internal midsole 1394 may be formed of molded polyurethane or nylon, or of a non-molded, rigid sheet material; and the T-bolt assemblies 1393 may preferably be formed of metal.

As shown and described above, the present invention provides a "step-in" binding assembly, including boots and bindings, that allows a snowboarder to quickly and easily attach or release one or both boots from a snowboard. To prevent injury, the binding assembly is designed to retain a snowboarder's boots therein during a fall.

It is specifically contemplated that the present invention may be modified or configured as appropriate for the application. It is intended that the foregoing detailed description be regarded as illustrative rather than limiting, and it should be understood that the following claims, including any equivalents, are intended to define the scope of the invention.

We claim:

1. A binding assembly comprising:

a boot comprising at least one set of two binding tabs, each of the binding tabs positioned along an opposing side of the boot;

a first binding element rotatably associated with a snowboard and configured to receive a first binding tab; and a second binding element rotatably associated with the snowboard and configured to receive a second binding tab, the second binding element comprising a releasable locking mechanism for locking the second binding element in a closed position;

wherein the binding tabs on the boot are maneuvered to engage the binding elements to mount the boot to the snowboard;

wherein the locking mechanism comprises a projection disposed on the second binding element and a spring-biased locking member operable to engage the projection; and wherein the spring-biased locking member comprises a barrel member having an inclined spiral plane operable to engage the projection.

2. The binding assembly of claim 1, wherein each of the first and second binding elements defines a recess adapted to receive a respective binding tab.

3. The binding assembly of claim 2 wherein the recess defined in each of the first and second binding elements defines an involute curve.

4. The binding assembly of claim 1, further comprising a biasing means for biasing the first binding element in a first position to receive the first binding tab.

5. The binding assembly of claim 1, further comprising an apparatus operatively associated with the locking mechanism to allow the second binding element to rotate from the closed position to an open position.

6. The binding assembly of claim 1 wherein the first binding element comprises a base defining first and second sets of slots therein, and a binding member connectively associated with the base by first and second shafts disposed within the respective first and second sets of slots.

7. The binding assembly of claim 6 wherein the first set of slots defines a first length and the second set of slots defines a second length, and further wherein the second set of slots defines an inclined area along at least a portion of the second length, whereby the first and second lengths operate to allow the first binding element to translate with respect to the snowboard and the inclined area operates to allow the first binding element to rotate with respect to the snowboard.

8. The binding assembly of claim 1 wherein the first binding tab is maneuvered first to engage the first binding element and the second binding tab is then maneuvered to engage the second binding element to secure the boot to the snowboard.

9. A binding assembly comprising:

a boot comprising at least one set of two binding tabs, each of the binding tabs positioned along an opposing side of the boot;

a first binding element rotatably associated with a snowboard and configured to receive a first binding tab; and a second binding element rotatably associated with the snowboard and configured to receive a second binding tab, the second binding element comprising a releasable locking mechanism for locking the second binding element in a closed position;

wherein the binding tabs on the boot are maneuvered to engage the binding elements to mount the boot to the snowboard; and wherein the first binding element comprises a base defining first and second sets of slots therein, and a binding member connectively associated with the base by first and second shafts disposed within the respective first and second sets of slots.

10. The binding assembly of claim 9, wherein each of the first and second binding elements defines a recess adapted to receive a respective binding tab.

11. The binding assembly of claim 10 wherein the recess defined in each of the first and second binding elements defines an involute curve.

12. The binding assembly of claim 9, further comprising a biasing means for biasing the first binding element in a first position to receive the first binding tab.

13. The binding assembly of claim 9 wherein the locking mechanism comprises a projection disposed on the second binding element and a spring-biased locking member operable to engage the projection.

14. The binding assembly of claim 13 wherein the spring-biased locking member comprises a barrel member having an inclined spiral plane operable to engage the projection.

15. The binding assembly of claim 13, further comprising an apparatus operatively associated with the locking mechanism to allow the second binding element to rotate from the closed position to an open position.

16. The binding assembly of claim 9 wherein the first set of slots defines a first length and the second set of slots defines a second length, and further wherein the second set of slots defines an inclined area along at least a portion of the second length, whereby the first and second lengths operate to allow the first binding element to translate with respect to the snowboard and the inclined area operates to allow the first binding element to rotate with respect to the snowboard.

17. The binding assembly of claim 9 wherein the first binding tab is maneuvered first to engage the first binding element and the second binding tab is then maneuvered to engage the second binding element to secure the boot to the snowboard.

* * * * *